US011959359B2

(12) United States Patent
Andreychuk et al.

(10) Patent No.: US 11,959,359 B2
(45) Date of Patent: Apr. 16, 2024

(54) SLEEVE VALVES, SHIFTING TOOLS AND METHODS FOR WELLBORE COMPLETION OPERATIONS THEREWITH

(71) Applicant: KOBOLD CORPORATION, Calgary (CA)

(72) Inventors: Mark Andreychuk, Calgary (CA); Per Angman, Calgary (CA)

( * ) Notice: Subject to any disclaimer, the term of this patent is extended or adjusted under 35 U.S.C. 154(b) by 0 days.

(21) Appl. No.: 17/715,251

(22) Filed: Apr. 7, 2022

(65) Prior Publication Data

US 2022/0228452 A1 Jul. 21, 2022

Related U.S. Application Data

(63) Continuation of application No. 16/515,881, filed on Jul. 18, 2019, now Pat. No. 11,346,169.

(60) Provisional application No. 62/702,200, filed on Jul. 23, 2018.

(51) Int. Cl.

| | |
|---|---|
| ***E21B 33/06*** | (2006.01) |
| ***E21B 23/00*** | (2006.01) |
| ***E21B 33/129*** | (2006.01) |
| ***E21B 34/14*** | (2006.01) |
| ***E21B 43/26*** | (2006.01) |

(52) U.S. Cl.

CPC ..... *E21B 34/14* (2013.01); *E21B 23/006* (2013.01); *E21B 33/1293* (2013.01); *E21B 43/26* (2013.01); *E21B 2200/06* (2020.05)

(58) Field of Classification Search

None

See application file for complete search history.

(56) References Cited

U.S. PATENT DOCUMENTS

| | | | |
|---|---|---|---|
| 5,513,703 | A | 5/1996 | Mills et al. |
| 6,513,595 | B1 | 2/2003 | Freiheit et al. |
| 7,090,020 | B2 | 8/2006 | Hill et al. |
| 7,337,847 | B2 | 3/2008 | McGarian et al. |
| 7,971,646 | B2 | 7/2011 | Murray et al. |
| 8,794,331 | B2 | 8/2014 | Getzlaf et al. |
| 8,955,603 | B2 | 2/2015 | Ravensbergen et al. |

(Continued)

FOREIGN PATENT DOCUMENTS

| | | |
|---|---|---|
| RU | 2475626 | 2/2013 |
| RU | 2577566 | 3/2016 |

OTHER PUBLICATIONS

English machine translation of RU 2475626.
English machine translation of RU 2577566.

*Primary Examiner* — Matthew Troutman
*Assistant Examiner* — Douglas S Wood
(74) *Attorney, Agent, or Firm* — Parlee McLaws LLP

(57) ABSTRACT

A shift uphole-to-open sleeve assembly is provided for insertion along a tubular string for multi-stage, selectable wellbore treatment. The sleeve assemblies are very short in length, being too short for in-sleeve engagement, and instead have a downhole shoulder engageable for opening using dogs of a conventional shifting tool. Use of a common J-mechanism having four axial inappropriately places the sealing packer of a downhole tool above the sleeve ports. Multiple extra J-mechanism cycles are required to position the packer downhole thereof. Herein a modified downhole tool is disclosed including a biased repositioning sub to eliminate many of the extra tool cycles. In embodiments the short sleeve can replace casing collars.

10 Claims, 19 Drawing Sheets

(56) References Cited

U.S. PATENT DOCUMENTS

| | | | | |
|---|---|---|---|---|
| 9,982,512 | B2 | 5/2018 | Getzlaf et al. | |
| 10,364,644 | B2 | 7/2019 | Zhou | |
| 10,472,928 | B2 | 11/2019 | Andreychuk et al. | |
| 11,268,347 | B2 * | 3/2022 | Olguin | E21B 34/14 |
| 11,346,169 | B2 * | 5/2022 | Andreychuk | E21B 17/08 |
| 11,441,579 | B2 * | 9/2022 | Nault | E21B 33/0355 |
| 2015/0041148 | A1 * | 2/2015 | Greenan | E21B 34/103 166/374 |
| 2016/0298404 | A1 | 10/2016 | Beckett et al. | |
| 2017/0058644 | A1 * | 3/2017 | Andreychuk | E21B 34/14 |
| 2017/0100366 | A1 | 4/2017 | Dressman et al. | |
| 2017/0175470 | A1 * | 6/2017 | Lesko | E21B 34/08 |
| 2018/0100366 | A1 * | 4/2018 | Johnson | E21B 47/09 |

* cited by examiner

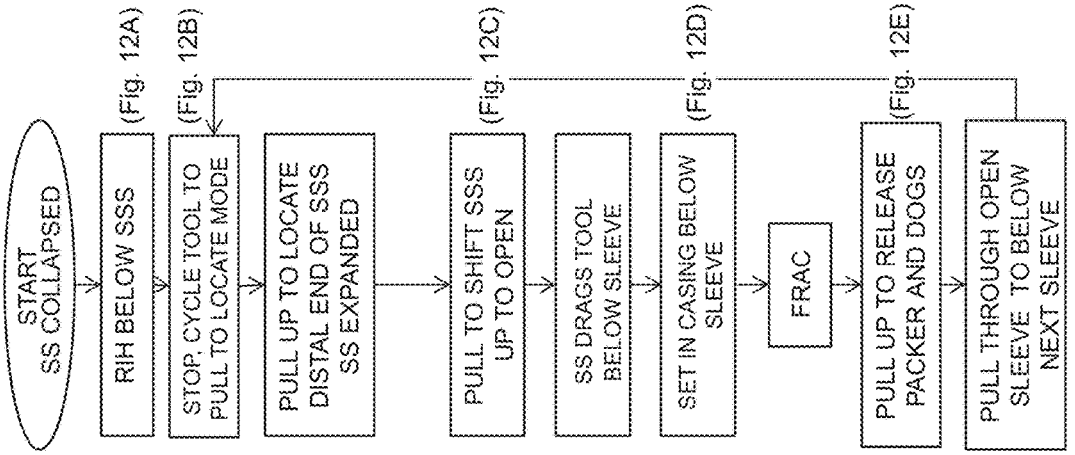
Fig. 12F
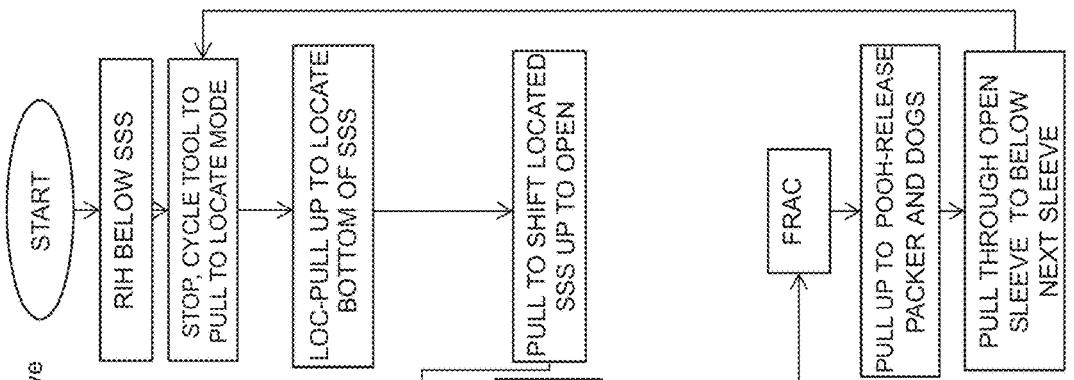
Fig. 8B
SSS -- Single Shift Sleeve
SS -- Slack Sub
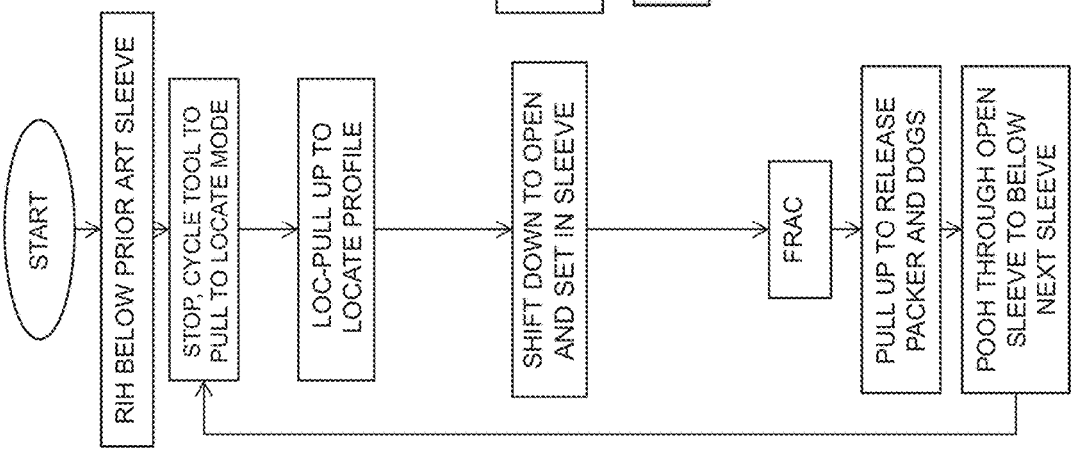
Fig. 7 - PRIOR ART 82
122
124
70
150
152
68
62
10
81
66
90
80
75
74

82
122
124
150
152
66

122
150
66

SLEEVE VALVES, SHIFTING TOOLS AND METHODS FOR WELLBORE COMPLETION OPERATIONS THEREWITH

CROSS REFERENCE TO RELATED APPLICATIONS

This application is a continuation of U.S. patent application Ser. No. 16/515,881, filed Jul. 18, 2019, which claims priority to U.S. Provisional Patent Application No. 62,702,200, filed Jul. 23, 2018, the entirety of each of which are incorporated fully herein by reference.

FIELD

Embodiments taught herein relate to apparatus and methods for use in wellbore completion operations and, more particularly, to apparatus and methods for shifting sleeves for opening ports spaced along a tubular string in a wellbore.

BACKGROUND

Conventional sleeve assemblies are used to open and close ports in tubular string extending along a wellbore. Each sleeve assembly comprises a tubular housing fit with a sleeve. The sleeve assemblies are typically spaced along casing, for permitting the flow of fluids through ports when the sleeve is shifted axially to expose ports in the housing or to block the flow of fluids therethrough when the sleeve covers the ports. Shifting tools are used for shifting the sleeve in a single shift operation to an open position, or can be manipulated to both open and to close in a multi-cycle operation. Downhole sliding sleeves having multiple open and close cycles, as guided by a J-mechanism, have been termed "multi-cycle" since at least 2003 as disclosed by Smith International Inc in U.S. Pat. No. 7,337,847B2 and "multi-cycle" dump valve for fracturing of packer isolated annulus intervals since 2002 as disclosed in US70909202 to Schlumberger Technology Corp.

Tubing-conveyed shifting tools sequentially manipulate a large number of sliding sleeve valves (cemented or uncemented) spaced along a casing string extending downhole for fracturing in an oil or gas well (vertical, deviated or horizontal). Open-only sleeve assemblies are typically operated in a toe-to-heel treatment and, for each treatment, a releasable packer can be positioned to isolate each treated zone below from the next uphole zone above.

Shifting tools have been utilized for decades in the wellbore cementing industry and in the late 1990's were typically limited to running in a profiled, key-type shifting tool downhole to shift a sleeve, which is then pulled out of hole, and then a subsequent tool is run in for fracturing through the open sleeve above a packer or between straddle packers.

Further, shifting sleeves downhole in extended horizontal wells becomes a challenge as surface applied force becomes weak and difficult to discriminate at great depths. In U.S. Pat. No. 5,513,703 to Mills and issued in 1996, the reliability of shifting a sleeve downhole to close was improved by actuating a packer to engage a sleeve and seal between the shifting tool and the sleeve. The impetus to drive the sleeve downhole to cycle the sleeve was assisted by a downward force on the packer, acting as a piston, generated by the fluid pressure introduced above the packer and into the annulus between the shifting tool and the packer-engaged sleeve.

In U.S. Pat. No. 8,794,331 to Getzlaf et al, the port closure sleeve assemblies implemented therein were located using a shifting tool having an implementation of casing collar locator at a downhole end thereof and which located the bottom of the sliding sleeve in the assembly. The sliding sleeves are therefore manufactured long enough to necessarily accept the concatenation of components above the collar locator including a J-mechanism and a resettable slip and packer assembly, the packer assembly being spaced uphole from the locator for engaging the inside of the sleeve thereabove.

Despite the challenges in the downhole shifting of remote sleeves, such sleeves are also susceptible to engagement and accidental shifting by a tool passing thereby while being run-in-hole (RIH) past the sleeve assembly. It is not unknown in completion operations that downward-facing shoulders or other protrusions on shifting tools can accidentally engage a sleeve and, if sufficient force is applied on run-in, can accidentally shift the sleeve downhole and unexpectedly open the ports. In some cases, the act of accidental shifting of the sleeve to the open position may not be detected at surface and is only discovered later when tubing integrity pressure tests fail or fluid is released to the formation at an unplanned zone therein. Particularly in multi-zone completions, there is a need for assurance regarding which sleeve assembly is open and which is not.

Another challenge with conventional sleeve valves assemblies is that they can often be relatively long so as to ensure there is sufficient length in which to ensure locating and in-sleeve engagement of the shifting tool intermediate along the sleeve. It is not unknown that such assemblies are over two or even over four feet in length. Further, additional lengths of tubulars or subs, which can be a further four or more feet in length, may be required at either end of the sleeve assembly to enable locating and ensure positioning and operating of the compatible bottomhole assembly (BHA) having shifting tools thereon. Additional sleeve length translates into additional material and manufacturing complexity and cost. Further, the heavy sleeves are more difficult to manage, even requiring the implementation of additional equipment simply for handling during makeup of the string.

There is interest in the oil and gas industry for sleeve assemblies that are relatively simple in design, hand-manageable, have a low cost, and furthermore are reliably engaged and operated to open ports, such as for hydraulic fracturing operations.

SUMMARY

Generally, due to the embodiments described herein, the resulting sleeve assemblies are suitable for multi-stage, selectable wellbore communication, such as for hydraulic fracturing. The sleeve assemblies are very short in length, low in unit cost, easy to handle by site personnel, and can be readily and reliably opened using known shifting tools having bore-engaging elements. In embodiments, a completion casing string, using sleeve assemblies, can replace the usual need for coupling casing collars, economically utilizing the sleeve assemblies as the only connections between adjacent casing sections.

In embodiments a known BHA, incorporating a shifting tool, is also disclosed that is capable of a basic single-shift, sleeve-opening function. Further, a modified BHA is additionally equipped with a repositioning sub for dragging the BHA downhole below an opened sleeve assembly with a minimum of cycling between tool operational modes, thus reducing operations costs, cycle fatigue of the tool-conveyance tubing string, and a per-unit cost of the sleeve assemblies themselves.

In combination, methods of multi-zonal fracturing are achieved using short open-only sleeve assemblies and a low-cycle or reduced-cycle BHA.

In one broad aspect of the invention, a completion string is provided for accessing a downhole formation comprising a string of tubulars at least some of which are connected by sleeve assemblies for selectable fluid communication from the tubular string to the formation. Each sleeve assembly has a sleeve housing having a housing bore and one or more ports to the formation formed through the housing. A sleeve is fit slidably to the housing bore and has a sleeve bore, the sleeve being slidable from a downhole closed position in which the ports are blocked by the sleeve, to a uphole open position in the which the ports are open. An annular recess is formed in the housing bore downhole of the sleeve and has a diameter greater than that of the sleeve bore, the sleeve having a downhole engagement shoulder extending radially into the housing bore.

In embodiments, a BHA having a shifting tool incorporated therein can engage the annular recess and downhole engagement shoulder with an engagement element or dog for shifting the sleeve uphole to the open position.

In embodiments, each sleeve assembly of the completion string can be short in length wherein each of the one or more ports have an axial extent; and the sleeve has a sleeve length between about 2.5 and about 3 times the axial extent of the ports. In embodiments, the sleeve length accommodates the axial extent of the ports and enough uphole and downhole sleeve overhangs to house uphole and downhole seals therein. For example, for ports having an axial extent of about 1 inch, the short open only sleeve has a sleeve length between about 2.5 and about 3 inches.

In embodiments, for incorporating an annular recess for receiving an BHA's engagement element, the sleeve bore has a diameter at or larger than that of the tubular string; and the annular recess has a diameter larger than that of the sleeve bore, the sleeve having a downhole engagement shoulder extending radially into the housing bore. Further, the housing bore has a downhole stop formed therein and the ports being spaced uphole therefrom, the sleeve bearing axially against the downhole stop in the closed position to block the ports uphole thereof, and the sleeve's downhole engagement shoulder extending radially into the housing bore at the downhole stop.

In another aspect, a sleeve assembly for a tubular string completed into a formation comprises a tubular sleeve housing having a housing bore within, one or more ports distributed circumferentially thereabout at an axial port location along the housing and formed therethrough, the ports having an axial extent; and a sleeve having a sleeve bore and fit to the housing bore and forming a sleeve annulus therebetween. The sleeve is slidably moveable axially along the housing bore from a first downhole position, blocking the one or more ports between the tubular bore and the formation, to a second uphole position, opening the one or more ports for fluid communication therethrough to the formation. The sleeve has an uphole end, a downhole end, and an axial length therebetween, the sleeve length accommodating at least an uphole annular seal in the sleeve annulus to seal the blocked ports from the sleeve annulus uphole thereof and at least a downhole annular seal to seal the blocked ports from the sleeve annulus downhole thereof.

In embodiments, the sleeve length can be minimized wherein each of the one or more ports have an axial extent; and the sleeve length is between 2.5 and 3 times the axial extent of the ports.

In another broad aspect, a method is provided for treating a zone in a formation accessed with a completion string having one or more sleeve assemblies therealong comprising running a bottom hole assembly (BHA) downhole on a conveyance string, to a location in the completion string below a selected sleeve assembly of the plurality of sleeves. The sleeve assembly is located and actuated to the open position by pulling uphole on the BHA to cycle an engagement element of the BHA to a locating mode and continue pulling up in locating mode until the engagement element radially engages an annular recess in a sleeve housing of the sleeve assembly, the recess being adjacent and downhole of a sleeve slidable in the sleeve housing. One continues pulling uphole on the BHA to engage the sleeve with the engagement element and shift the sleeve uphole to an open position to open treatment ports through in the sleeve housing. Once open, one runs the BHA downhole to cycle the engagement element to a run-in-hole mode and continues running the BHA downhole to position a resettable packer and slip assembly of the BHA downhole of the selected sleeve assembly. To treat the formation, one sets the packer and slips across the completion string and begins treating the formation through the opened treatment ports. After treatment, the BHA is pulled uphole to release the resettable packer and slip assembly and continue pulling uphole reposition the BHA uphole of the selected sleeve assembly.

In embodiments, the BHA has a J-mechanism comprising at least four axial positions, an intermediate downhole position D1 in which the engagement elements are constrained radially inward for free run-in hole (RIH) movement downhole; an extreme uphole position U1 in which the engagement elements are biased radially outward for locating (LOC) the housing recess downhole of the sleeve; an extreme downhole position D2 for setting (SET) the resettable packer and slip assembly across the completion string; and an intermediate uphole position U2 in which the engagement elements are constrained radially inward for free pull-out-of-hole (POOH) movement uphole.

Implementing the four position J-mechanism, and after shifting the sleeve uphole to the open position, the step of running of the BHA to position the resettable packer and slip assembly to below the selected sleeve assembly further comprises: running the BHA downhole in RIH mode to cycle the J-mechanism; soft setting the BHA in SET mode to cycle the J-mechanism; pulling the BHA to POOH mode and position the BHA above the selected sleeve; running the BHA downhole to below the selected sleeve assembly in RIH mode; pulling the BHA to LOC mode to cycle the J-mechanism; and setting down on the BHA for setting the packer and slips across the completion string in SET mode.

In embodiments the number of cycles between opening successive sleeve assemblies is reduced with a modified BHA wherein the BHA further comprises a telescopic BHA repositioning sub situate between the J-mechanism uphole thereof and a drag block downhole thereof, and wherein: the shifting of the sleeve uphole to the open position further comprises telescoping the repositioning sub to an extended, energized position; and, the running of the BHA to position the resettable packer and slip assembly to below the selected sleeve assembly further comprises setting down on the BHA in SET mode for releasing the energy of the extended repositioning sub for collapsing the repositioning sub and dragging at least a slip portion of the resettable packer and skip assembly downhole of the open, selected sleeve assembly without actuating the resettable packer and slip assembly; and once the repositioning sub is collapsed, further setting down on the BHA for setting the packer and slips across the completion string in SET mode.

The telescoping of the repositioning sub to an extended, energized position comprises frictionally restraining a J-mechanism housing and slips with the drag block, pulling a J-mechanism mandrel uphole to space the packer from the slips in LOC mode, and operatively energizing a biasing spring within the repositioning sub between the mandrel and the housing; the setting down of the BHA for releasing the energy of the extended repositioning sub comprises biasing the J-mechanism housing and slips downhole towards the drag block while the J-mechanism mandrel follows downhole, the BHA repositioning below the open, selected sleeve.

In another aspect, a modified bottom hole assembly (BHA) is provided and conveyed downhole on a conveyance string for actuating a sleeve assembly of a completion string having one or more of the sleeve assemblies therealong. The BHA comprises a BHA mandrel slidable within a BHA housing downhole thereof and a J-mechanism operative therebetween, the BHA mandrel connected at an uphole end to a conveyance string and having a packer thereon, the BHA housing having slips at an uphole end thereof and connected to a drag block at a downhole end for restraining the BHA housing along the completion string, and a telescopic BHA repositioning sub situate between the BHA housing uphole thereof and the drag block downhole thereof wherein, the repositioning sub having a slack mandrel connected to the BHA housing, a slack housing connected to the drag block and a biasing spring between the slack mandrel and the slack housing for energizing upon compression thereof upon an uphole pull of the BHA mandrel and connected slack mandrel and energy being released upon a release of the sleeve engagement elements from the sleeve housing for telescoping the slack mandrel towards the slack housing and dragging the BHA housing downhole thereof.

The BHA further comprises a shifting tool having one or more engagement elements connected to the BHA housing and movable axially relative to the BHA mandrel and radially actuable between a radially outward biased position to locate and shift the sleeve assembly to an open treatment position, and a radially inward collapsed position for free movement in the completion string, a cone movable axially with the BHA mandrel between two positions, an engaged position with the housing's engagement elements to urge them in the radially outward position and a disengaged position, and a packer for sealing to the completion string in the cone's engaged position.

In embodiments, the slack mandrel telescopically extends from the slack housing by a stroke length, the stroke length being greater than the distance between the spacing between slips and the packer in the cone engaged position wherein when the cone moves axially from the engaged to the disengaged position, the slack mandrel telescopically drags the BHA housing downhole and the packer is dragged downhole of the sleeve assembly.

BRIEF DESCRIPTION OF THE DRAWINGS

FIG. 7 is a flowchart outlining the steps of shifting a prior art sleeve using a BHA fit with the prior art J-mechanism equipped shifting tool of FIG. 6A to engage the prior art sleeve's internal profile or recess and enable shifting of the functions of the sleeve;

FIG. 8B is a flowchart outlining the steps for operation of the prior art shifting tool of FIGS. 6A, 6B and cycling the J-mechanism for locating an open-only sleeve of FIGS. 1, 2, shifting the sleeve, treating the formation through the selected sleeve and re-locating to the next sleeve;

FIG. 11A illustrates the uphole end of the single shift BHA with a releasable sealing element, and a J-shifting mechanism comprising arms and sleeve engagement elements or dogs thereon, the dogs shown in a collapsed position to permit running into hole (RIH) such as casing;

FIG. 11B illustrates the slack sub in isolation, having a slack housing and having a slack mandrel for coupling with the BHA J-mechanism, the slack sub shown in an axially-collapsed position with the drag spring situate between the slack mandrel and housing in the extended, relaxed position presented during run-in-hole (RIH), and set (SET) for fracturing;

FIG. 11C illustrates the BHA in a pull-to-locate (LOC) mode having the arms and dogs biased radially outwardly to ride along the bore of the casing string and shown having located a sleeve housing recess downhole of the sleeve; and FIG. 11D illustrates the slack sub in an extended position with the slack mandrel telescopically extended from the slack housing and the drag spring energized or compressed therebetween, such as during LOC and POOH modes;

FIG. 11E illustrates the engagement dogs having engaged the sleeve housing recess having been pulled uphole to the open position, the slack sub now extended and the spring energized according to FIG. 11D;

FIG. 11F illustrates the dogs having been dragged downhole from the sleeve assembly, the energized slack mandrel having dragged the J-housing arms and associated dogs downhole towards the drag block, the slack sub moving from the extended position to the collapsed position and auto-cycling the J-mechanism from pull to open LOC to SET modes for setting the dogs in the casing string and compressing the packer element in the casing string below the sleeve assembly; and FIG. 11G illustrates the reduced cycle BHA, subsequently cycled uphole to retract the arms and dogs for pulling-out-of-hole (POOH), the packer having been relaxed, the slack mandrel being pulled uphole, and moving again to the extended position, compressing the drag spring;

FIG. 12A illustrates the BHA while RIH just downhole of the closed sleeve assembly;

FIG. 12B illustrates the BHA while LOC, the dogs engaging the downhole end of the sleeve;

FIG. 12C illustrates the BHA with the sleeve pulled uphole to open and the slack sub fully energized;

FIG. 12D illustrates the slack sub collapsed, shown having drawn the dogs downhole from the sleeve and still spaced from the resettable packer assembly;

FIG. 12E illustrates the BHA while in POOH mode with the BHA uphole of the selected sleeve for repositioning at the next sleeve or tripping out of the wellbore;

FIG. 12F, shown side by side with FIGS. 7 and 8B, is a flowchart outlining the reduced number of cycles for shifting the sleeve according to embodiments taught herein utilizing the BHA of FIGS. 9-12E;

DETAILED DESCRIPTION

Figure 1:
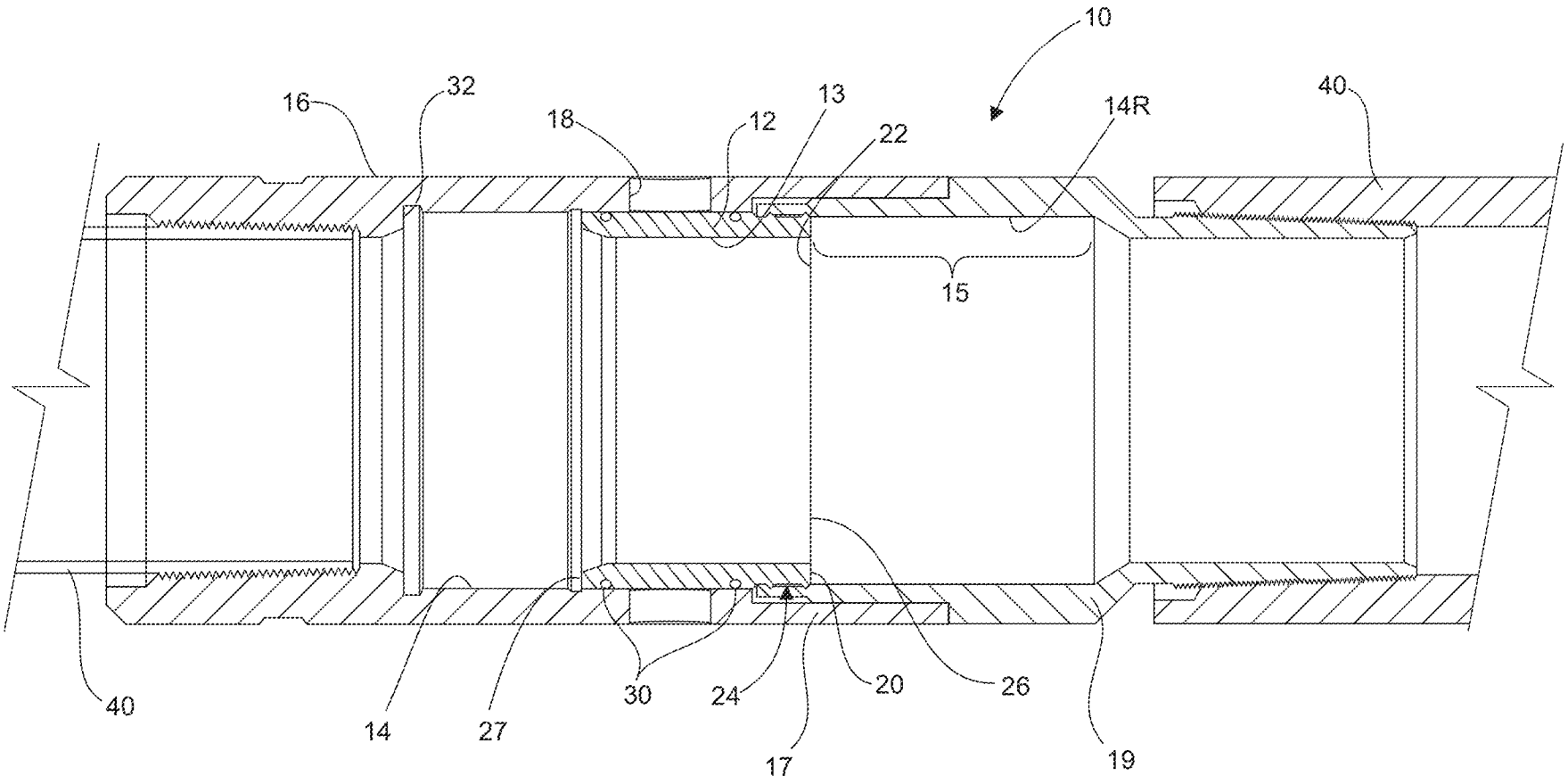
FIG. 1 is a cross-sectional view of a single-shift sleeve assembly of a tubular housing and a sleeve therein, according to an embodiment taught herein, the sleeve shown in a downhole closed position for blocking the flow of fluids through a plurality of ports in the tubular housing.
Figure 2:
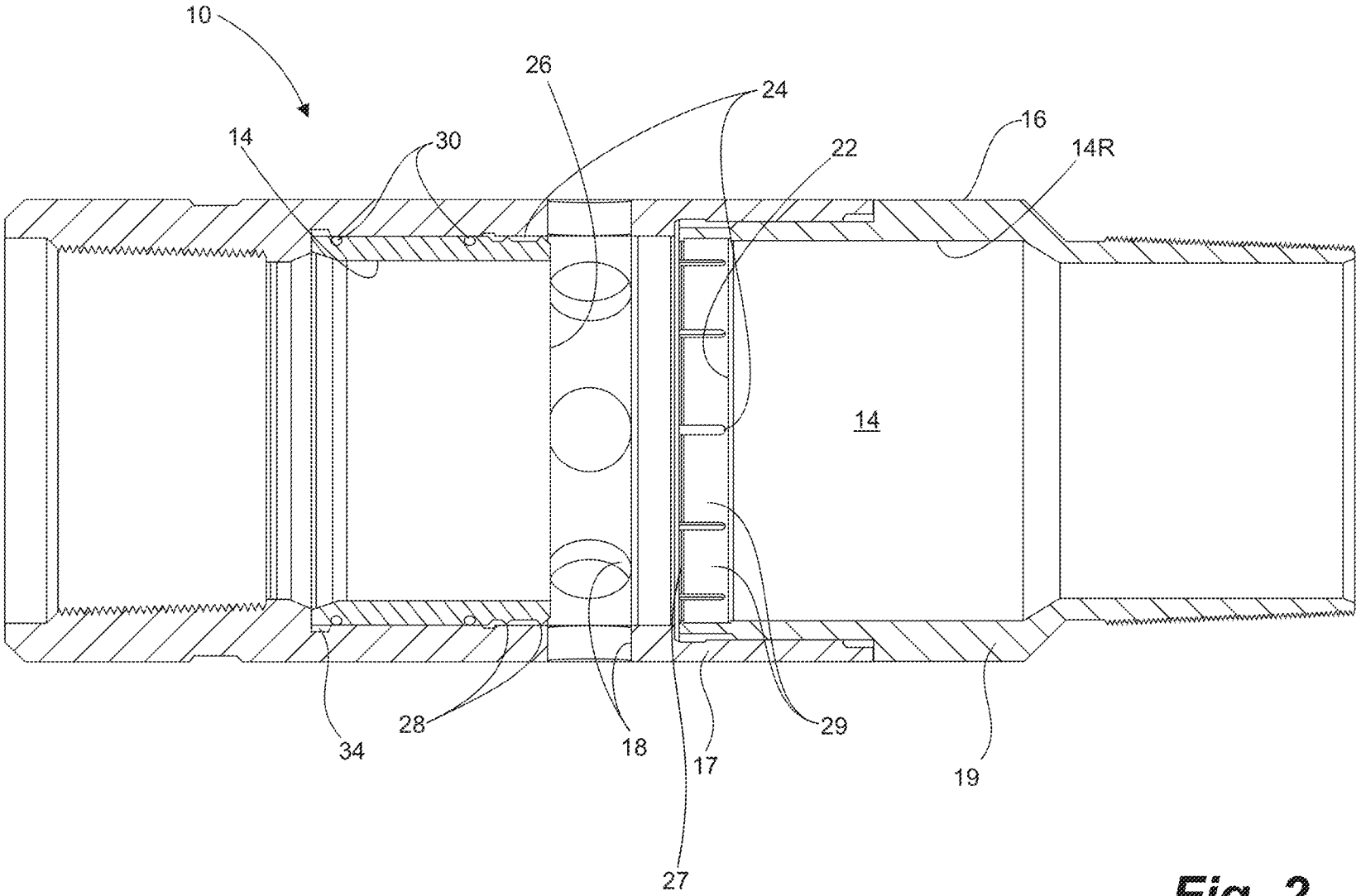
FIG. 2 is a cross-section view of the single-shift sleeve, according to FIG. 1, shown with the sleeve shown in the axial uphole open position for unblocking flow of fluids to the plurality of ports.

Having reference to FIGS. 1 and 2, embodiments taught herein comprise a single-shift sleeve assembly 10, wherein a tubular sleeve 12 is axially shiftable within a bore 14 of a tubular housing 16. The housing 16 is installed, such as by threaded connections, between facing ends of adjacent tubulars in a tubular string along the wellbore, typically a completion or casing string 40.

At least some of the tubulars in the string, such as those in the formation of interest, are connected by sleeve assemblies 10 for selectable fluid communication from the tubular string to the formation. The sleeve 12 is fit slidably to the housing bore 16 and has a sleeve bore 13, the sleeve 12 being slidable from a downhole closed position in which the ports are blocked by the sleeve, to an uphole open position in which the ports are open. The one or more ports are formed through the housing 16 and are openable and closeable to the formation.

The sleeve 12 is initially in a closed position (FIG. 1), aligned axially in the housing 16 for blocking flow through one or more ports 18 located and distributed circumferentially about in the housing 16 at an axial port location along the housing 16 and formed therethrough. The ports have an axial extent, typically circular, that determines the minimum length of the sleeve 12.

For fluid communication between the tubular bore 14 and the wellbore outside of the tubular 16, the sleeve 12 is shifted uphole to an open position (FIG. 2) to axially expose the ports 18 and permit flow of treatment fluids therethrough.

Figure 6A:
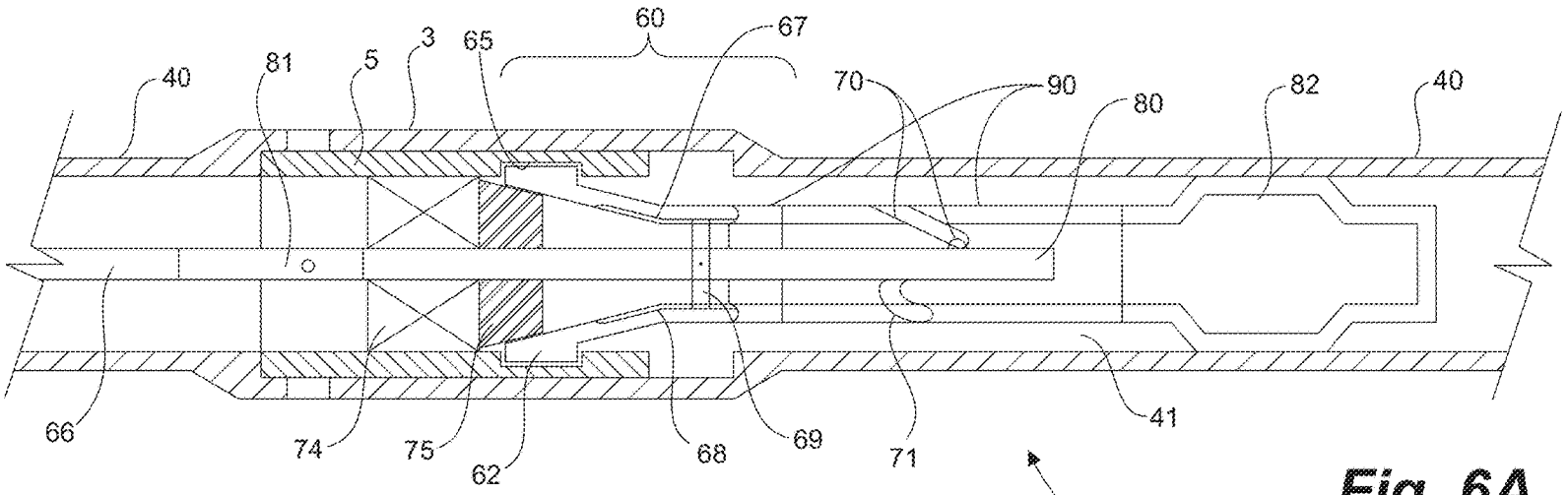
Fig. 6A PRIOR ART
FIG. 6A is a schematic cross-sectional view of Applicant's prior art BHA published as US20170058644A1.

Shifting uphole-to-open is contrary to most conventional completion operations for treatments such as multi-stage hydraulic fracturing operations. As shown in FIG. 6A, Applicant has also employed in shift downhole-to-open sleeve assemblies, having certain advantages in implementing the J-mechanism shifting cycles. However, in long horizontal wellbores, the shifting of sleeves downhole becomes increasingly challenging proportionately to the length of wellbore to be treated, due to the increasing difficulty of applying a functional downhole force through the long slender conveyance string to a downhole bottom hole assembly (BHA).

Accordingly, herein, an open-uphole sleeve assembly is provided, the pulling of a conveyance string having some advantages in the application of force over the conventional downhole push arrangements. Further, the modification in the operation of conventional BHAs and an alternate BHA is reviewed herein.

Having reference again to FIG. 1, in the initial closed position, the open uphole sleeve 12 is a tubular, slidably fit to the housing bore 14, and having a bore 13 smaller than that of the housing bore 14. An annular recess 14R formed in the housing bore 14 downhole of the sleeve 12 and has a diameter greater than that of the sleeve's bore 13. The sleeve bore 13 has a diameter at or larger than a string bore diameter of the tubular string for passage of BHA therethrough. The annular recess 14R has a diameter larger than that of the sleeve bore 13 resulting in a downhole engagement shoulder extending radially from the sleeve 12 into the housing bore 14, forming a downhole-facing shoulder 20 at a distal end 26 thereof.

The housing bore 14 has an uphole-facing stop 22 formed therein and the ports 18 are spaced uphole therefrom. A closed sleeve bears axially against the uphole-facing stop in the closed position to block the ports 18 uphole thereof, and the sleeve's downhole engagement shoulder 20 extends radially into the housing bore at the uphole-facing stop.

Closed, the sleeve's shoulder 20 rests against the uphole facing stop 22 formed at a localized narrowing of the bore 14 of the tubular housing 16 downhole of the sleeve 12. A pair of seals 30,30, situate in the annulus between the housing bore 14 and the sleeve 12, axially straddle the ports 18 to minimize fluid leaks therethrough and provide pressure integrity when closed.

The sleeve 12 has an uphole end 27, the downhole end 20, and an axial length therebetween, the sleeve length accommodating at least an uphole annular seal 30 in the sleeve annulus to seal the blocked ports 18 along the sleeve annulus uphole thereof and at least a downhole annular seal to seal the blocked ports along the sleeve annulus downhole thereof.

Minimizing the sleeve length, each of the one or more ports 18 have an axial extent and the sleeve 12 has a sleeve length between about 2.5 and about 3 times the axial extent of the ports.

The sleeve 12 can be temporarily retained in the downhole closed position using a first retainer 24, such as a detent or shear screw acting between the housing 16 and the sleeve 12. The sleeve's downhole-facing shoulder 20 bears against the uphole-facing stop 22 to mitigate against accidental movement of the sleeve 12 when a BHA, or other tool is run-in-hole (RIH) through the sleeve assembly bore 14. Further, the first retainer 24 can have a low retaining force which is overcome to operate the sleeve to the open position compared to prior art retainers for downhole-opened sleeves that are exposed to accidental downhole opening forces. In embodiments, the first retainer 24 can be released at a force of less than about 2000 daN and is better suited to the weak at-tool application forces available in deep wells.

Generally, the risk of accidental uphole opening of a sleeve on any particular uphole traverse is low. Most downhole tools or BHAs are already designed with tapered uphole shoulders and connections to freely allow the tools to readily be pulled-out-of-hole (POOH) without significant engagement with the casing string, sleeves, and the like. Accordingly, there is low risk that even the low-force detent could be accidently overcome to open the shift-up-to-open sleeve 12.

In embodiments taught herein, the downhole-facing shoulder 20 of the sleeve 12 extends radially inwardly from the housing bore 14. Described in greater detail below, the BHA and integrated shifting tool, having radially extending sleeve engaging elements, can be pulled uphole into the housing 16 to traverse the housing bore 14. The engaging elements engage a recess 15 formed by the radial difference between the housing bore 14 and the sleeve bore 13. The recess 15 is formed downhole of the sleeve 12 at the downhole-facing shoulder 20. An additional uphole force on the elements overcomes the first retainer 24 to shift the sleeve 12 uphole.

With reference to FIG. 2, after the sleeve 12 is pulled uphole, the exposed ports 18 are open between the tubular bore 14 and the wellbore outside of the tubular 16.

Best seen in FIG. 2, the first retainer 24 can be cooperating collet and annular rings, the tubular collet having flexible fingers 29 extending uphole from the housing 16 and the sleeve 12 which bears complementary annular rings 27 upstanding radially between the housing 16 and sleeve 12.

The sleeve 12 is absent a profile or other feature along the axial length of the sleeve that would need to cooperate directly in juxtaposition with a shifting tool and having a comparative recess-accommodating length. Thus, an overall length of the sleeve 12 and assembly 10 can be manufactured significantly shorter than prior art sleeves valves and benefiting from commensurate manufacturing and installation cost savings as a result.

In embodiments, the length of the sleeve 12 can be as short as about 2.5 to about 3 times the axial extent of the ports 18, typically the diameter thereof. By way of example, the axial length of the overall sleeve assembly 10, including about 5½" (or API standard 5.563") diameter housings 16, is about 9 inches (about 23 cm) compared to Applicant's prior art, in-sleeve engagement sleeve assemblies, which are from about 26 to about 30 inches (about 66 cm to about 76 cm) in length, or known in-sleeve shifting sleeve assemblies that can be up to many feet long. The illustrated sleeve 12, located within the housing bore 14, is about 3 inches in length (about 7.6 cm), having 1 inch diameter ports and the sleeve travels axially therein about 2 inches (about 5 cm) between closed and open positions. In other embodiments, the length of the sleeve 12 can be limited to that needed to cover the axial extent of the circumferential array of ports and having uphole and downhole end that extend or overhang beyond the ports 18 sufficiently to support the seals 30,30. In embodiments, the overhang is about 1" (2.5 cm).

The sleeve 12 comprises two or more O-ring seals 30, at least two of which are spaced apart on an outer surface 32 of the sleeve 12 for positioning at least one O-ring seal 30 in sealing engagement against the housing 16 uphole of the one or more ports 18 and at least one O-ring seal 30 downhole of the one or more ports 18 in the closed position. The seals 30,30 seal between the sleeve 12 and the tubular housing 16 and need only be competent to prevent leakage thereby before being opened.

In FIG. 2, in embodiments, in the open position, the sleeve 12 can be held open using a second retainer 34, such as a detent, grapple lock, snap ring, or the like, acting between the sleeve 12 and the housing 16 to engage the sleeve 12 thereto. Not detailed, a grapple hook can reside within an annular recess at the uphole end of the housing bore 14. The retainer 34 need not be releasable, or easily releasable, as the sleeve 12 is expected to remain open in normal service.

Engagement of the sleeve 12 by the BHA is generally observed as a weight change at surface. As the BHA is pulled uphole, the uphole pulling force first overcomes the first retainer 24 for releasing the sleeve 12 from the housing 16. Continued pulling force causes the 27 sleeve 12 to shift uphole for opening the plurality of ports 18. The uphole end of the sleeve bears against a stop 32 at the uphole end of the housing bore 14 and detected at surfaced with an indicated force greater than that of the prior first retainer release force.

Single-Shift Sleeve Assembly as a Casing Coupling

Figure 3:
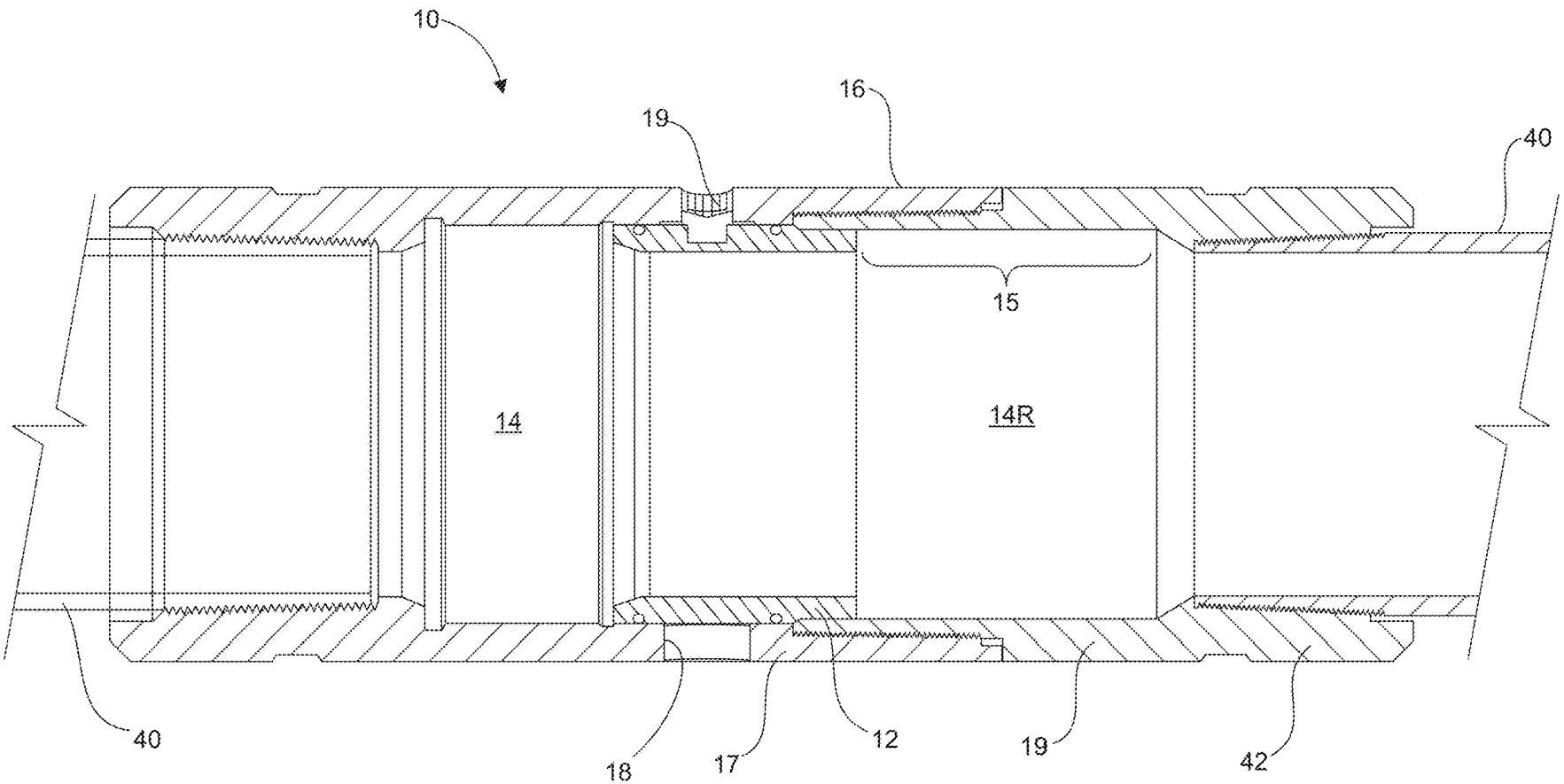
FIG. 3 is a cross-sectional view of an embodiment of the single-shift sleeve assembly with a sectional housing configured as a casing coupler between pin-end joints of conventional casing, an annular shifting recess formed in the housing and located adjacent a downhole end of the sleeve in the closed position.
Figure 4:
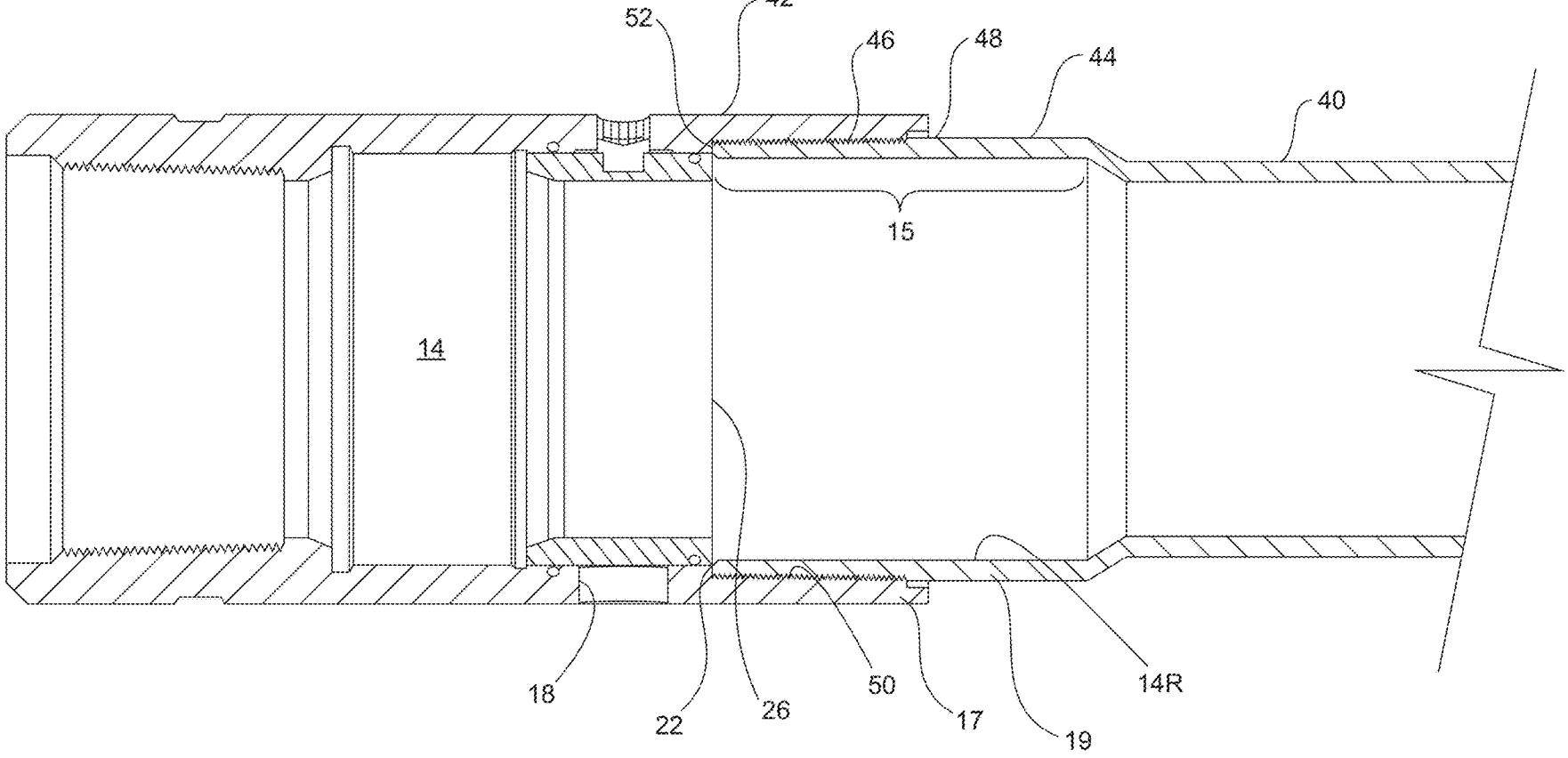
FIG. 4 is a cross-sectional view of an embodiment of the single-shift sleeve assembly with an alternate unitary structural embodiment of the assembly housing used as a casing coupler for jointed casing, the downhole casing having external upset casing compatible with the unitary housing structure and forming the shifting recess therein.
Figure 5:
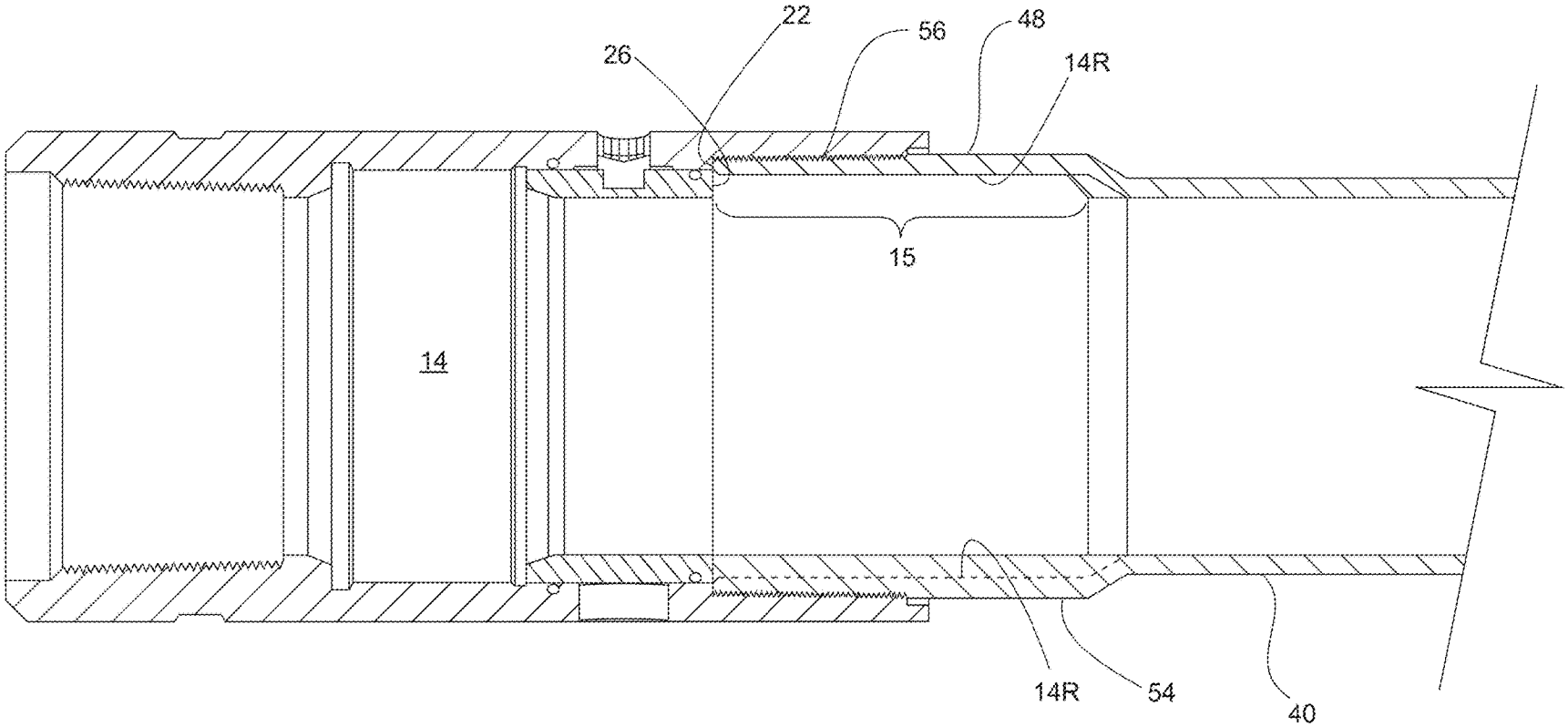
FIG. 5 is a cross-sectional view of an embodiment of the single-shift sleeve assembly with an alternate unitary structural embodiment of the assembly housing of FIG. 4, the upset casing having the inner diameter of the uphole end machined radially to enlarge the bore greater than that of the sleeve's bore for forming the shifting recess for receiving shifting elements of shifting tool and functional access to the sleeve's downhole shifting shoulder.

Having reference to FIGS. 3 to 5, the short tubular housing 16 enables incorporation of the single-shift sleeve assembly in a casing string 40 as the means for coupling sections of adjacent tubulars in the wellbore and which can replace conventional couplers or collars. Duplication of casing-coupling at the depth of the reservoir zones for treatment, by both collars and sleeve assemblies, is avoided. As a result, the overall cost of the completion string 40 is lower than would be the case where both casing couplers and added sleeve assemblies 10 are used.

In embodiments, the housing 16 of the sleeve assembly 10 can be designed to be incorporated into a string of casing or other tubulars 40 having a variety of different coupling configurations, including conventional tubulars having opposing pin and box ends (FIGS. 1 and 2), opposing pin ends (FIG. 3) or external upset casing box ends (FIGS. 4 and 5).

The assembly of the housing 16 is manufactured so as to enable axial installation of the sleeve 12 into the housing bore 14. The housing 16 can be two parts 17, 19 to incorporate a first housing portion 17 having a housing bore 14 and ports 18, the bore 14 being full diameter at a first end for axial access for initial installation of the sleeve 12 thereinto and a second housing portion 19 having a reduced diameter portion 14R, or sub, threadably coupled to the first portion 17, securing the sleeve 12 therein. The uphole end of the reduced diameter housing bore 14R can form the uphole facing shoulder 22 or stop for the sleeve shoulder 20.

As shown in FIGS. 1 and 2, a conventional pin end can be threaded into an uphole box end of the housing 16 and a box end can be threaded onto the downhole end of the housing 16.

As shown in FIG. 3, in embodiments, a casing tubular 40 having opposing pin ends can be threaded into uphole and downhole box ends of the sleeve's housing 16.

Having reference to FIG. 4, in embodiments for use with external upset box end casing, the downhole end 42 of the first housing portion 17 has an internal diameter capable of accommodating the larger outer diameter of the second housing portion 19 formed by the external upset 44 on the downhole casing 40, when threaded therein. A separate conventional second portion or sub is not required as the first portion 17 of the housing 16 is threaded to connect directly to the upset casing. External threads 46 are machined on an external surface 48 of the upset portion 44 for threading into threads 50 machined in the downhole end 42 of the first portion of the housing 16. An uphole end 52 of the external upset portion 44 of the casing 40, when threaded into the sleeve housing 16, forms the uphole-facing shoulder 22 upon which the distal end 26 of the sleeve 12 rests, acting as the downhole-facing shoulder 20. The distal end 26 of the sleeve 12 extends radially inwardly into the bore 14 beyond the downhole casing 40 for engagement therewith by the shifting tool.

As shown in FIG. 5, in an embodiment, casing 40 having an external upset 44 with a thick wall can be machined to form the bore 14R and to permit a box end thread to be cut therein for use with conventional casing collars. The additional machining accommodates the sleeve's housing 16 and forms the uphole facing shoulder 22. In this embodiment, instead of the box end thread being cut, pin end threads 56 are cut on the external surface 48 of the upset portion 44, and material is removed from the inner diameter to form the uphole facing shoulder 22. Care is taken in removing the excess material to provide a transition from the upset portion 44 to the remainder of the casing 40 to avoid forming a shoulder or protrusion on which tools run through the casing 40 and sleeve assembly 10 could engage.

In embodiments, each joint of casing 40 extending along the treatment portion of the wellbore has pre-assembled thereon a sleeve assembly 10 configured as a casing coupler, as taught above, eliminating the need to make an additional connection for every joint of casing 40 during lining of a wellbore, thus saving additional cost.

Apparatus and Methods for Shifting of the Single-Shift Sleeve

Embodiments taught herein are described generally in the context of a BHA having a shifting tool engaging within the sleeve 12 of a sleeve assembly 10. As is well understood in the art, in embodiments used in a multiple-stage fracturing operation, the shifting tool is incorporated into a downhole tool or BHA. The BHA incorporates components used to open the ports 18, isolate the wellbore below the open ports, and to deliver fracturing fluid to the formation thereabout. The downhole tool may be referred to in combination as a BHA, or as a BHA incorporating a shifting tool as the context suggests.

BHA with Standard Shifting Tool

As shown in FIG. 6A, a prior art, standard BHA 100 utilizes sequential up and down J-mechanism cycles for each tool mode. In Applicant's pending application published as US20170058644A1 on Mar. 2, 2017, the entirety of which is incorporated herein by reference, a shifting tool was incorporated in a BHA 100 using shifting elements such as keys or dogs 62 intended for use in the engaging within an annular profile formed intermediate prior art sleeves. The BHA 100 is conveyed downhole on a tubing conveyance string 66, such as coiled tubing (CT) or jointed tubulars. The dogs 62 are located at uphole ends of radially controllable, and circumferentially-spaced, support arms 68.

The dogs 62 of the prior art BHA 100 locate and engage at an intermediate location 65 along a sleeve 5 of the sleeve assembly 3. Movement of the dogs 62 manipulates the shifting of the sleeve 5, for either opening or closing. Manipulation of the arms 68 and dogs 62 are achieved using uphole and downhole movement of the BHA 100 and an associated BHA mandrel 80. The arm 68 is fit with cams 67 for variable control of the radial position of the connected dogs 62. A cam-encircling ring forms a restraining ring 69 axially slidable along the arm's cams 67 for determining various radially inward and outward shifting options. An alternate form of the restraining ring 69 is disclosed in Applicant's US provisional application U.S. 62/619,707, filed Jan. 19, 2018.

In short, the BHA 100 has a BHA housing 90 that is frictionally engaged in the casing 40 by a drag mechanism 82. The BHA mandrel 80 is telescopically movable within the BHA housing 90. The BHA mandrel 80 is connected to the conveyance string 66. Movement of the conveyance string 66 moves the BHA mandrel 80 and connected J-Pin along a J-Profile 71 for manipulating the mandrel 80 axially relative to the housing 90 and arms 68. The housing 90 and mandrel 80 are fit with the J mechanism 70 for changing axial modes.

The J-mechanism 70 enables arms 68 and dogs 62 to be actuable radially inward, overcoming biasing, constrained to a smaller diameter for either downhole run-into-hole (RIH) mode and uphole pull-out-of-hole (POOH) mode movement. Further, the dogs 62 can be released radially outwardly for locating the sleeve (LOC) mode or locked into engagement with the sleeve or casing including actuating resettable packer 74 and cone 75 for blocking the casing annulus 41.

Figure 8A:
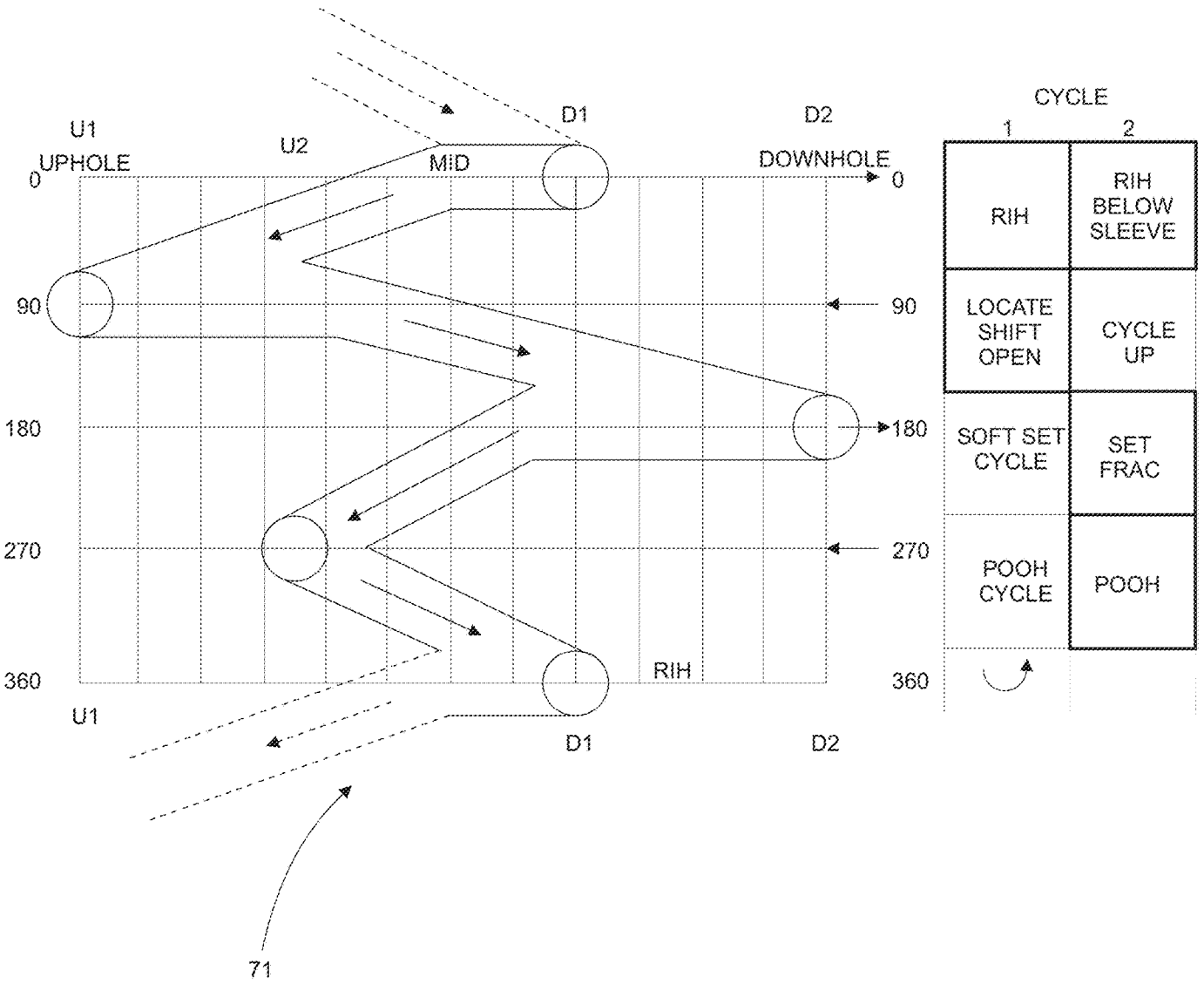
FIG. 8A is a rolled-out illustration of a J-mechanism J-Profile, having extreme and intermediate uphole stops and extreme and intermediate downhole stops, being manipulated through two cycles used to open the single shift shifting sleeve and then reposition the prior art BHA of FIG. 6A below the sleeve assembly for treatment before moving to the next sleeve uphole, the functional cycles bolded in outline.
Figure 9:
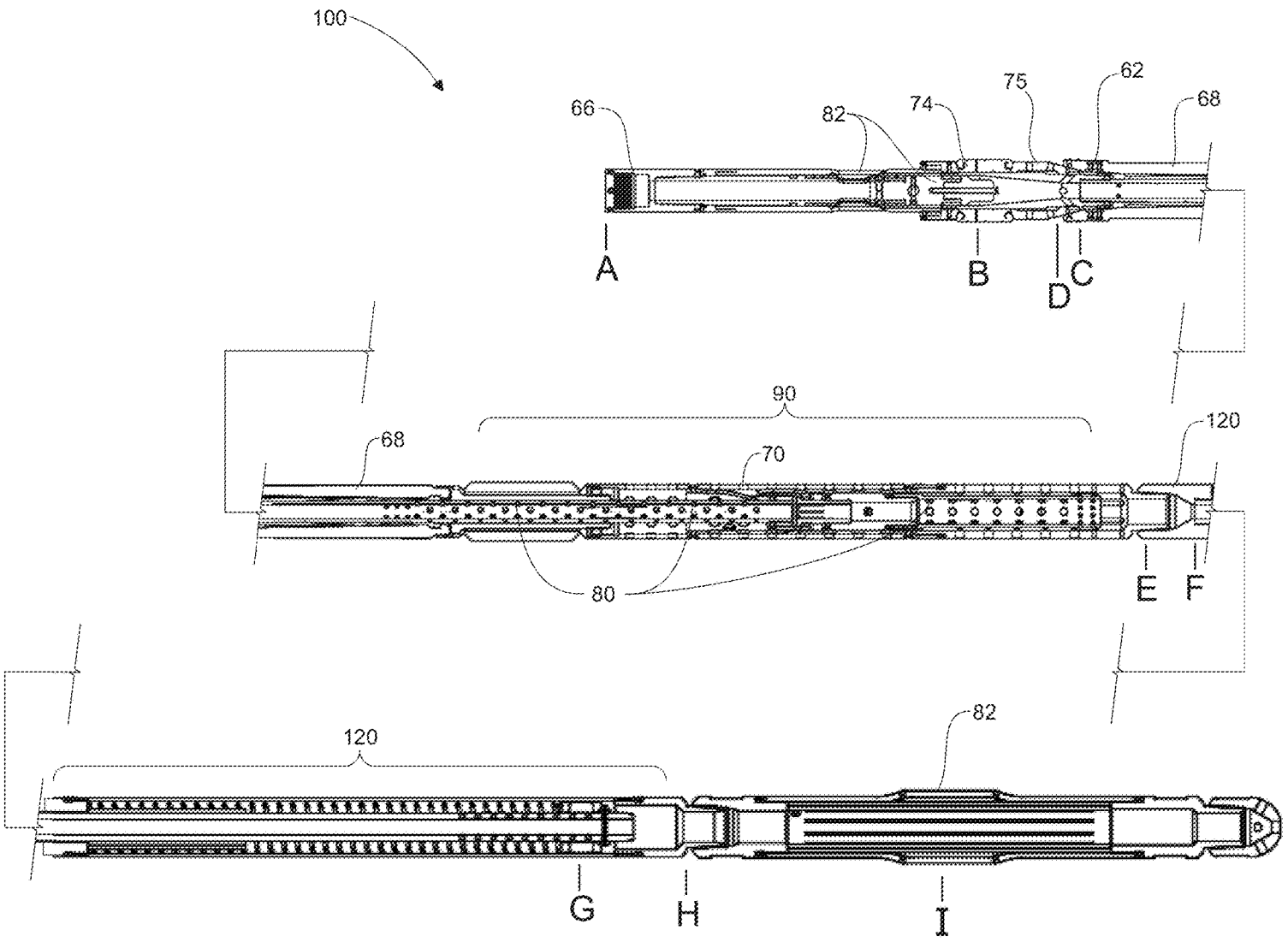
FIG. 9 is a cross-sectional view of a low-cycle alternative embodiment of a single shift BHA and shifting tool further incorporating a telescopic repositioning sub, or slack sub for reducing J-mechanism cycles and repositioning the BHA's packer and slip assembly, after opening the sleeve for fracturing according to embodiments taught herein, the slack sub being situate between the J-mechanism and the drag block, the slack sub shown in the collapsed position.
Figure 10:
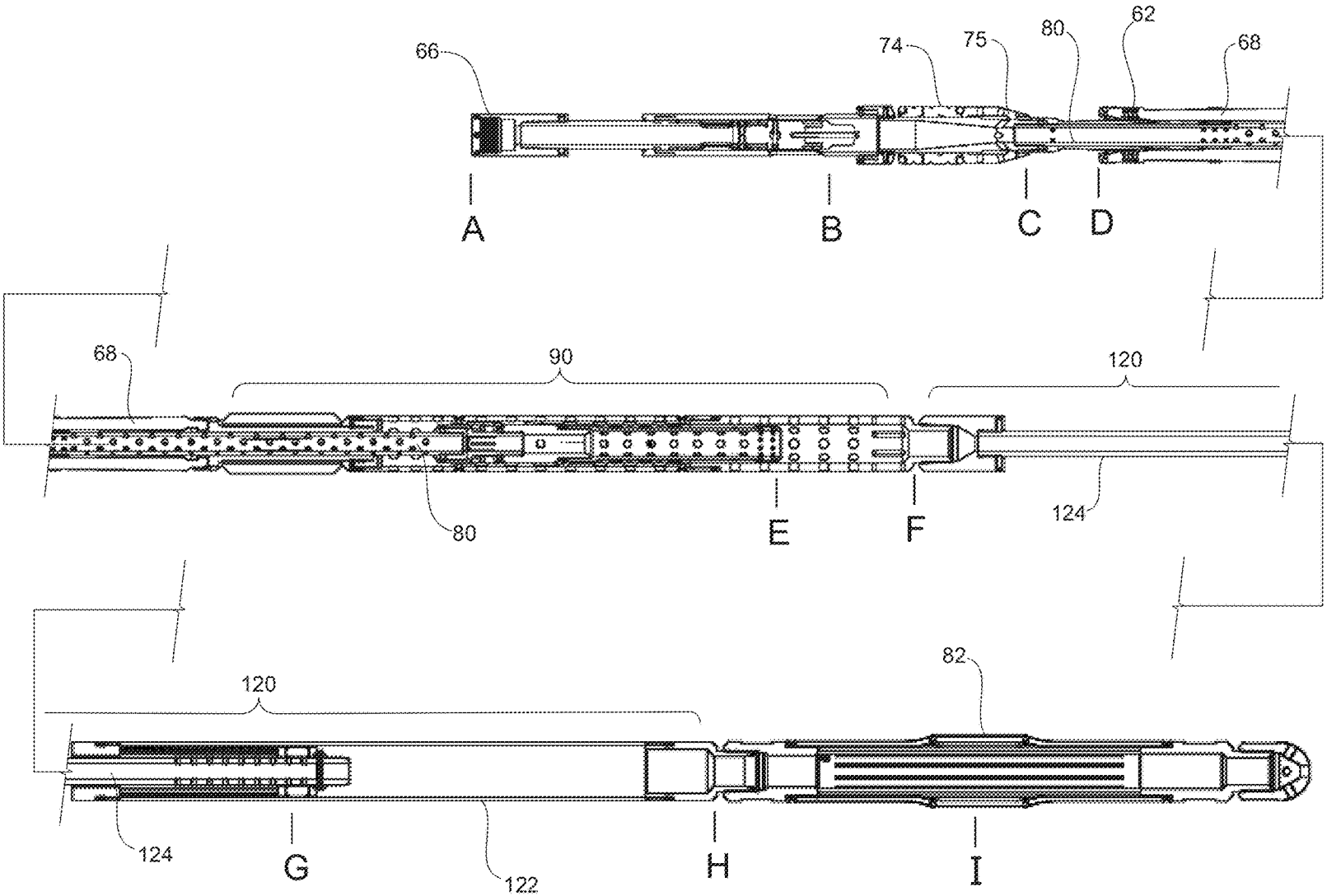
FIG. 10 is a cross-sectional view of the reduced cycle BHA embodiment according to FIG. 9, the slack sub shown in the extended position.
Figure 13:
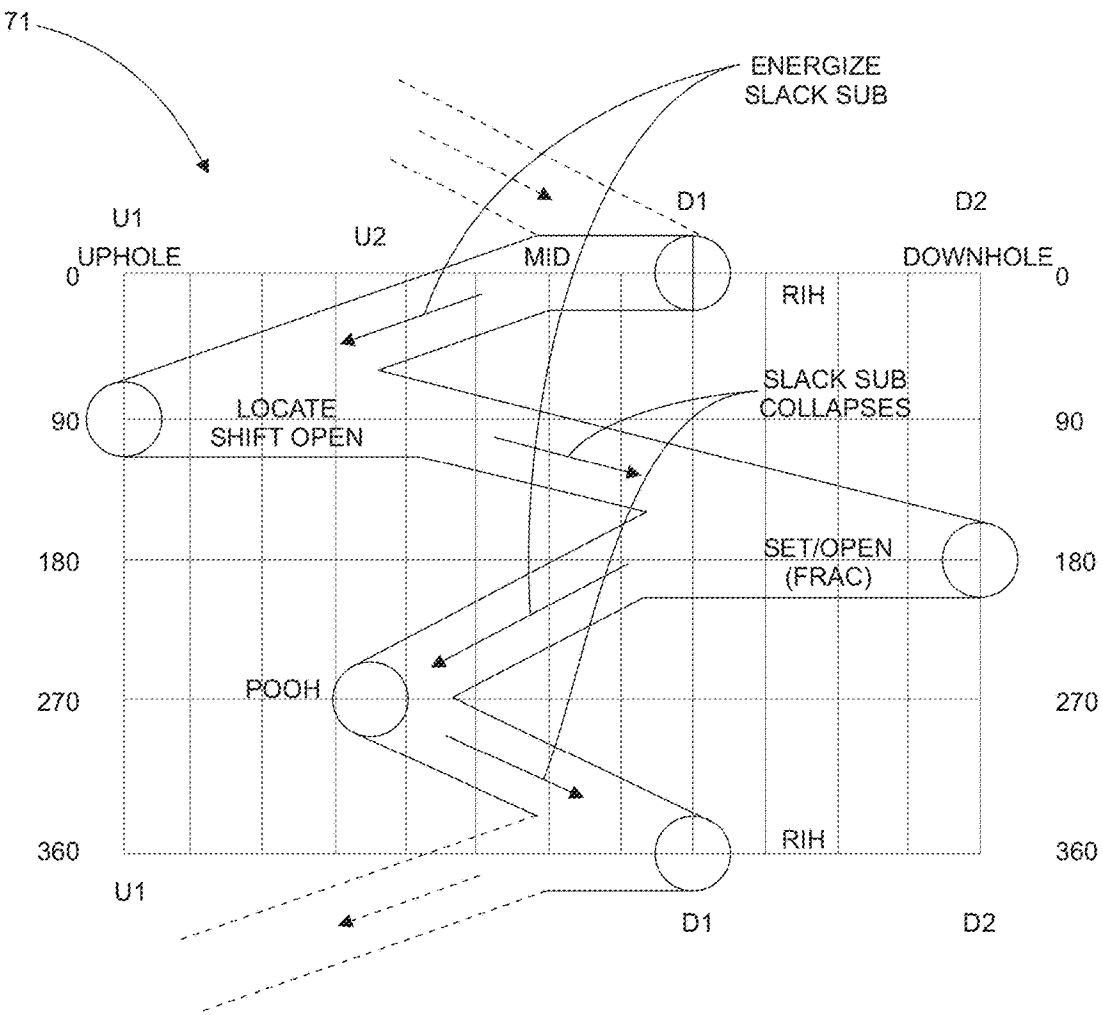
FIG. 13 is a rolled-out illustration of a J-mechanism profile, having extreme and intermediate uphole stops and extreme and intermediate downhole stops, for use with the reduced cycle BHA of FIGS. 11A to 11G.

With reference also to FIGS. 8A and 13, in embodiments, a J-Profile enables actuation of the BHA 100 to at least four axial positions. Of the four axial positions, two are extreme positions: one first extreme position downhole D2 that drives a cone into engagement with the dogs 62 to lock the dogs into a located sleeve profile (SET) mode; and one second extreme uphole position U1 that first frees the dogs for biased dragging or locating (LOC) mode along the inside wall of the completion string for locating the sleeve profile. The remaining modes are intermediate axial positions (U2, D1), both of which restrain the dogs' radial position to enable free movement uphole (POOH) mode and downhole (RIH) mode within the casing string 40 respectively.

As shown in FIG. 7, the prior art BHA 100 would be RIH to a location in the casing 40 below the sleeve assembly 3. The J-mechanism 70 was cycled by a pull uphole, releasing the arms 68 axially to LOC mode, the dogs 62 biased against the casing and dragged uphole to locate the sleeve 5. Once located in profile 65, the conveyance string 66 was lowered to SET mode, engaging the packer cone 75 and dogs 62 for locking the dogs and sleeve 5 together, and setting the packer 74 sealably across the sleeve 5 for fracturing through the opened sleeve assembly 3. An uphole pull released the packer 74, separated the cone 75 from the dogs 62 and restrained the arms 76 to the inward position for POOH mode. Continued uphole movement permitted movement of the BHA 100 to the next sequential sleeve.

However, for the current embodiment, for a short, shift-open sleeve assembly, a packer cannot set across the short sleeve, as the ports would also be covered. Thus, the packer is to be set in the casing 40 below the sleeve assembly. The prior art J-mechanism sequence can also be implemented for free running in the casing 40 and setting of the packer 74 downhole of the sleeve assembly. However, as the prior art J-mechanism sequence moves directly from sleeve LOC to SET mode of the packer, extra repeated cycles would now need to be required so as to manipulate the BHA 100 below the sleeve assembly before setting the packer to seal the casing 40.

Prior Art BHA for Open-Only Sleeves

Figure 6B:
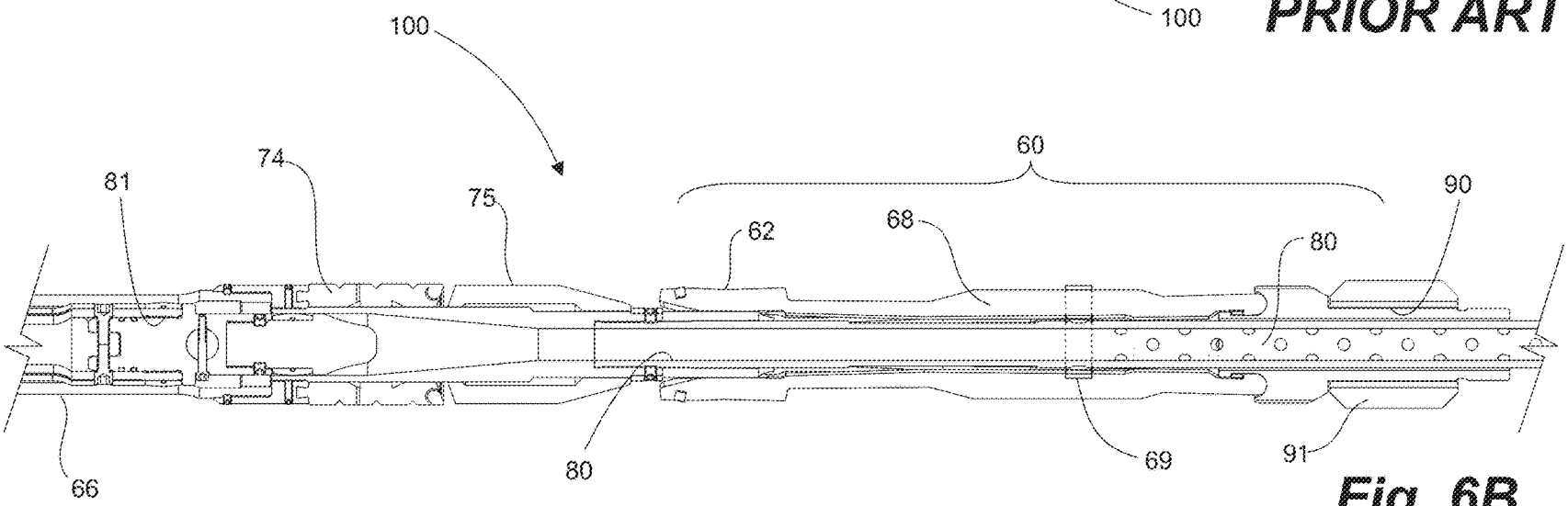
Fig. 6B PRIOR ART
FIG. 6B is a cross-sectional view of the shift tool portion of Applicant's prior art BHA according to FIG. 6A, and having recess-engaging elements or dogs controlled through cycling of a J-mechanism.

Turning to the J-Profile 71 of FIG. 8A and the flowchart of FIG. 8B, the axial position of the BHA mandrel 80 of FIG. 6B to the sleeve of FIG. 1 is controlled by the J-mechanism 70 of conventional design. Axial positioning of the BHA mandrel 80, relative to the cams 67 on the dog arms 68, at least selectively restrains or constrains the dog's radial position for enabling engagement and disengagement of the sleeve 12. The J-mechanism 70 applies at least four distinct positions of the restraining ring 69 along the arms 68 so as to positively actuate the dogs 62 for both uphole and downhole operation, to engage the sleeve 12, to lock the dogs to the sleeve 12 or lock the dogs to the casing 40 for fracturing operations, and yet also be releasable for longitudinal or axial movement to the next sleeve assembly 10.

In summary, the BHA has a J-mechanism comprising at least four axial positions, an intermediate downhole position D1 in which the engagement elements are constrained radially inward for free run-in hole (RIH) movement downhole; an extreme uphole position U1 in which the engagement elements are biased radially outward for locating (LOC) the housing recess downhole of the sleeve; an extreme downhole position D2 for setting (SET) the resettable packer and slip assembly across the completion string; and an intermediate uphole position U2 in which the engagement elements are constrained radially inward for free pull-out-of-hole (POOH) movement uphole.

Generally, a method for treating a zone in the formation accessed by the completion string comprises running the BHA 100 downhole on the conveyance string 66, to a location below a selected sleeve assembly 10 of the plurality of sleeve assemblies. One pulls uphole on the BHA to cycle the dogs of the BHA to the LOC mode and a continued pulling radially engages the dogs 62 in the annular recess 14R in the sleeve housing 16. Further pulling uphole on the BHA 100 engages the sleeve 12 and dog 62 and shifts the sleeve uphole to an open position to open the treatment ports 18 through the sleeve housing. Once open, the BHA is run downhole to cycle the dogs to the RIH mode. The BHA is run downhole to position the resettable packer 74 and dogs 62 downhole of the selected sleeve assembly 10.

This conventional BHA 100 requires additional J-mechanism cycles to set the packer and dogs across the completion string and before treating the formation through the opened treatment ports. After treatment; pulling uphole on the BHA 100 releases the resettable packer and slip assembly and a continued pulling uphole repositions the BHA uphole of the selected sleeve assembly.

In more detail, the BHA mandrel 80 is initially cycled for run-in-hole RIH mode D1 and the BHA 100 is run downhole to a location in the casing 40 below the sleeve 12. The BHA mandrel 80 is cycled by pulling uphole to LOC mode U1 wherein the arms 68 and dogs 62 are released radially outwardly. Pulling up on the conveyance string 66 drags the dogs 62 along the casing 40 until the dogs 62 locate the increased diameter recess 15 of the sleeve housing bore 14 downhole of the sleeve 12. The dogs 62 engage the distal or downhole end 26 of the sleeve 12.

Location of the distal end 26 of the sleeve 12 by the dogs 62 is noted by the operator at surface as an increase in coiled tubing (CT) weight on a CT weight indicator. The operator continues to pull uphole to overcome the first retainer 24 and the single-shift sleeve 12 shifts uphole to the open position. The opening of the sleeve 12 can be verified by continuing to pull uphole with the dog 62 bearing against the sleeve 12 and the opened sleeve bearing against an uphole shoulder 32 of the housing 16. The overpull weight is observed on the CT weight indicator at surface. The CT depth is then recorded and is indicative of the location of the distal end of the single-shift sleeve. CT depth is most accurate when the CT is being pulled in tension.

As shown in FIG. 2, once shifted to the open position, the sleeve 12 is engaged in the open position by the second retainer 34 which prevents the sleeve 12 from shifting back to the closed position of FIG. 1, as discussed above.

All that is required next is to block the wellbore below the sleeve assembly 10 to treat the formation through the opened ports 18. However, the next available J-mechanism sequence is to lower the BHA mandrel 80 downhole which engages the cone 75 and dogs 62 in SET mode for expanding the packer 74. Setting the BHA 100 in this intermediate position is ineffective for the fracturing step as the packer 74, at the time of the SET mode, is located uphole of the frac 18 ports and the dogs 62 remain located within the sleeve assembly housing 16, substantially positioned at the frac ports. Instead, additional cycles are performed to enable repositioning of the packer 74 of the BHA to a new position below the sleeve assembly before the SET mode is attempted again.

Conventional J-Mechanism

With reference more specifically to FIG. 8A, in one embodiment of operation, this known BHA 100 and the operating mode of the shifting tool arrangement therein can be implemented to locate, engage, and shift the operating sleeve 12 uphole and then include further cycles to reset 16 BHA by running the BHA further downhole to below the opened sleeve 12 for setting the packer 74 to the casing string 40 to seal or block the wellbore and frac through the opened 18 ports 18 above the packer. The manipulation of the BHA 100 through the various modes is performed using a series of up and downhole cycling of the conveyance string 66.

To axially move and set the packer 74 downhole, the BHA 100 is first cycled downhole by a soft-set of the packer, cone, and dog arrangement, temporarily moving to the SET mode D2 merely to cycle the J-mechanism. The BHA 100 is cycled again to the POOH mode U2 to constrain the dogs 62 and arms 68 radially inwardly and the BHA is pulled uphole so that the dogs 62 are repositioned above the sleeve 12, typically by a displacement distinguishable at surface, say by a few feet. Next the BHA 100 is cycled downhole again to RIH mode D1 to allow the BHA to be moved axially and freely downhole. The arms and dogs are restrained in the radially inward collapsed position and the BHA 100 is RIH until the BHA is below the recorded CT tension depth, such as about 10 feet below.

The J-mechanism 70 is then cycled to POOH mode U2 by pulling uphole, after which the BHA is moved to SET mode again by setting down to mode D2 to engage the cone and packer with the dogs, setting the dogs in the case 40 as slips and compressing the packer 74 to ensure the casing is seated below the sleeve assembly 10 to isolate the wellbore therebelow.

Following fracturing, the BHA is pulled uphole to POOH mode U2 to release the packer 74, collapsing the arms 68 and dogs 62 for releasing the BHA 100 which is pulled axially uphole to the next sleeve assembly 10 in the casing string 40. Prior to reaching the next sleeve assembly and still downhole thereof, axial movement of the BHA is stopped and the J-mechanism 70 is cycled to RIH mode D1 to the LOC mode U1. The process as described above is then repeated.

In summary, five additional cycles are employed before the treatment can proceed, namely, running the BHA downhole in RIH mode to cycle the J-mechanism; soft setting the BHA in SET mode to cycle the J-mechanism; pulling the BHA to POOH mode and positioning the BHA above the selected sleeve; running the BHA downhole to below the selected sleeve assembly in RIH mode; pulling the BHA to LOC mode to cycle the J-mechanism; and setting down on the BHA for setting the packer and slips across the completion string in SET mode to seal the casing string below the open sleeve.

Accordingly, while multiple sleeves assemblies 10,10 . . . can be sequentially opened subjected to fracturing operations the using the prior art shifting tool, the process requires a number of operational steps merely used for cycling the BHA axially uphole and downhole through J-mechanism so as to reposition the BHA below the opened ports 18. The additional cycles can also introduce inaccuracy in the settling location of the packer depending upon the accuracy of the determination of the CT tension depth at surface.

Reduced Cycle Shifting Tool

As shown in an alternate embodiment of FIGS. 9, 10A to 10G, 11 and FIGS. 12A through 12E, embodiments of a reduced cycle BHA 102 are shown having a reduced cycle shifting tool incorporated therein.

The modified BHA 102 is described in which the number of operating cycles, to shift the sleeve 12 uphole to open the frac ports 18 and then move the resettable packer 74 downhole of the open frac ports for hydraulic fracturing, can be reduced and avoid cycling through the full J-Profile to configure the BHA before setting.

The modified BHA 102 further comprises a slack sub 120 for enabling a biased-downhole displacement or repositioning of the shifting tool housing after a uphole manipulation. Unlike conventional J-mechanisms, the BHA 102 can be shifted from the sleeve opening to reposition downhole of the sleeve assembly 10 without a need to manipulate the conveyance string 66 through extra cycles.

The J-mechanism applied with the modified BHA 102 comprises the previously described and complementary BHA mandrel 80 and BHA housing 90 components, one connected to the uphole conveyance string and the other connected to a downhole drag block. Typically the mandrel 80 is connected to the conveyance string and the housing 90 connected to the drag block.

Simply, a reduced cycle telescopic BHA 102 is provided including a repositioning or slack sub situate between the J-mechanism 70 uphole thereof and the drag block 82 downhole thereof. The method of using the reduced cycle BHA 102 comprises energizing the repositioning sub to an extended, energized position upon the shifting of the sleeve 12 uphole to the open position. To reposition the BHA below the opened sleeve, one runs the BHA 102 downhole to position the resettable packer 74 and dog 62 assembly to a location below the selected sleeve assembly 10 by setting down on the BHA in SET mode for releasing the energy of the extended repositioning sub by collapsing the repositioning sub and dragging at least the dog portion downhole of the open, selected sleeve assembly 10 without actuating the resettable packer 74. Once the repositioning sub is collapsed, further setting down on the BHA 102 sets the packer and dogs across the completion string in SET mode.

In detail, the repositioning or slack sub 120 is situate between the downhole drag beam 82 and the BHA housing 90. The mandrel 80 is secured to the conveyance string, the surface movement of which is insensitive to the relatively weak axial forces downhole. Uphole movement of the conveyance string 66 pulls the mandrel 80 uphole.

The slack sub 102 acts between a downhole end of the BHA housing 90 and the drag beam 82 for biasing the BHA housing downhole from the LOC mode position when released from the sleeve. The BHA housing 90 is biased downhole to a fracturing location below the sleeve assembly 10, wherein the packer 74 and dogs 62 are spaced below the distal end of the assembly 10.

The slack sub 120 acts to eliminate the series of extra manipulations of FIGS. 8A and 8B, that are required when using the prior art shifting tool 100 to configure the BHA 100 to move the packer 74 and the dogs 62 to a position below the sleeve assembly 10.

Figure 11A:
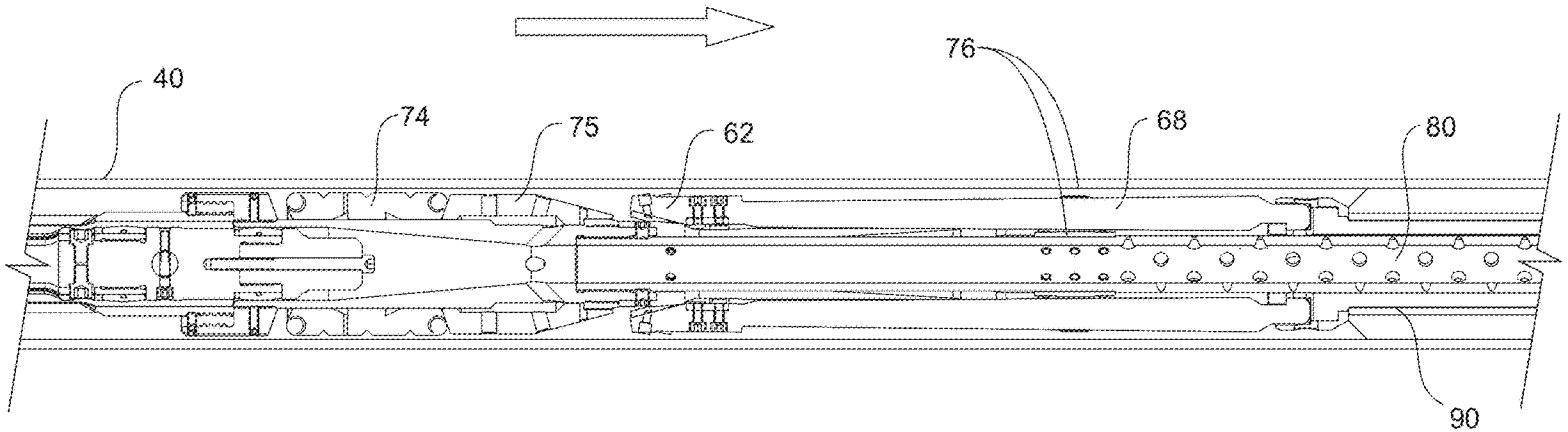
FIGS. 11A to 11G are cross-sectional representations of components of the single-shift BHA of FIGS. 9 and 10, according to embodiments taught herein, and more particularly.
Figure 11B:
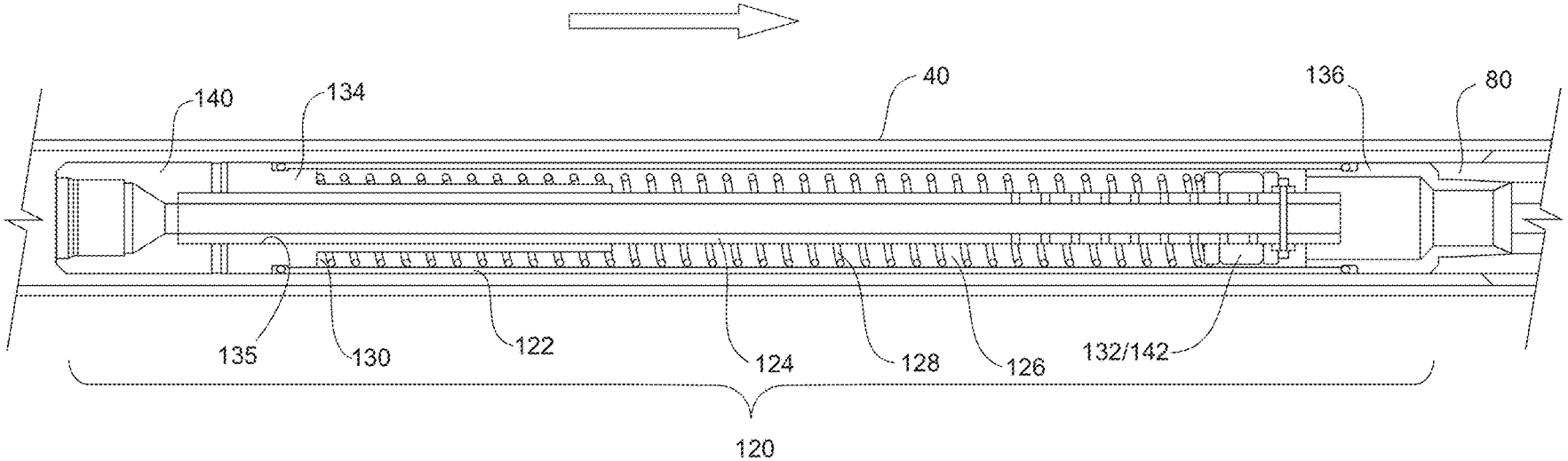
Figure 11C:
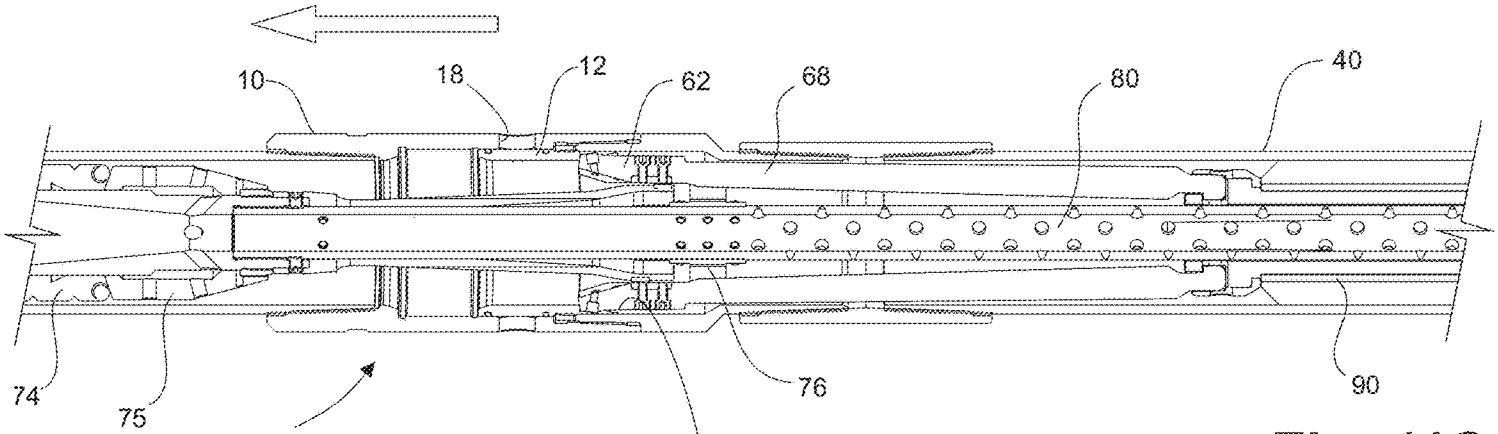
Figure 11D:
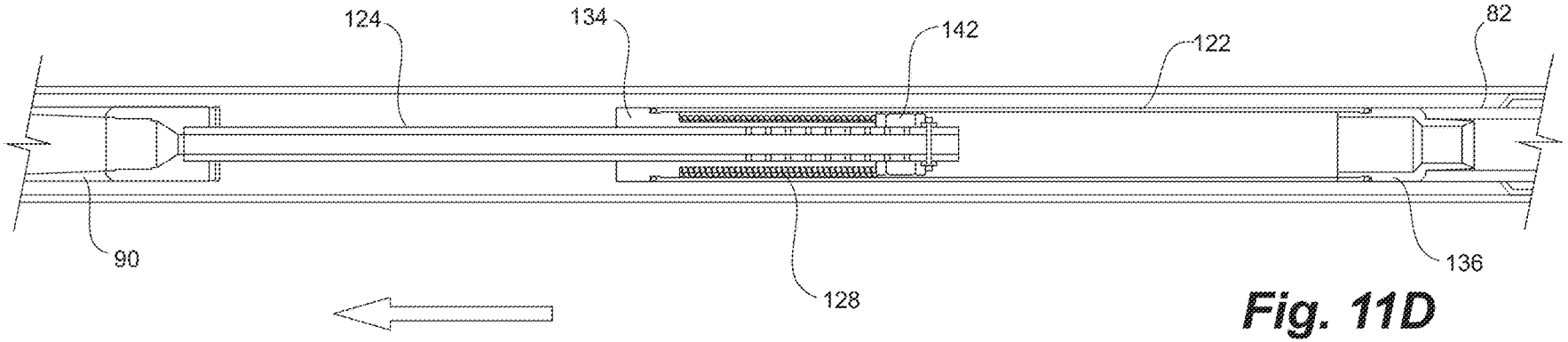

As shown in FIGS. 11B and 11D, the slack sub 120 is a telescoping apparatus, having a tubular outer slack housing 122 and an inner slack mandrel 124, the slack mandrel 124 and a slack annulus 126 formed therebetween. The slack mandrel 124 is telescopically and axially moveable into and out of the slack housing 122 between a collapsed position (FIGS. 9, 8, 11A and B) and an extended position (FIGS. 10, 11C and 11D) relative to the outer housing 122. A drag spring 128 is positioned annularly about the mandrel 124 in the slack annulus 126 and is retained thereabout within the slack housing 122. The drag spring 128 acts to bias the slack mandrel 124 back for retraction into the slack housing 122 to the collapsed position.

An uphole sub 134 of the slack housing 122 forms a downward facing shoulder as an uphole spring stop 130 and a downhole sub 136 for connection with the drag beam 82 assembly. The slack mandrel 124 further comprises a top sub 140 for connection with the downhole end of the BHA housing 90. The downhole end of the slack mandrel 124 further comprises an adjustable spring retention nut 142 adjacent a distal end thereof and forming a downhole spring stop 132 for engaging the distal end of the drag spring 128. As the slack mandrel extends out of the slack housing, the drag spring 128 is compressed between stop 130 and stop 132. The uphole sub 134 has a bore 135 through which the slack mandrel 124 slidably passes. The drag spring 128 is compressed between the uphole spring stop 130 and the downhole stop 132 of the adjustable spring retention nut 142. The adjustable spring retention nut 142 and can be variably positioned and retained axially along the slack mandrel to pre-establish variable tension in the drag spring 128 and a distance of travel of the BHA 120 connected thereto.

Slack mandrel 124 has an uphole end 140 that is connected to the downhole of the BHA housing 90, typically to the bottom of the J-housing 70, and a downhole end 136 of the slack housing 122 is connected to the drag beam assembly 82.

In use, the slack sub 120 adopts the collapsed position when the BHA is being run-in-hole (RIH) and during fracing in SET mode. When the BHA 102 is pulled uphole, such as to locate or to shift the sleeve 12 of the sleeve assembly 10, the drag beam assembly 82 provides sufficient frictional restraining drag force to retain the position of the slack housing 122 axially within the casing 40 while the slack mandrel 124 is pulled axially uphole with the BHA 102. The downhole retention nut 142 of the slack mandrel 124 approaches the uphole stop 130 of the slack housing 122 as the slack mandrel 124 moves to the extended position. The slack spring 128 is compressed to an energized position.

Figures 12A, 12B, 12C, 12D, 12E:
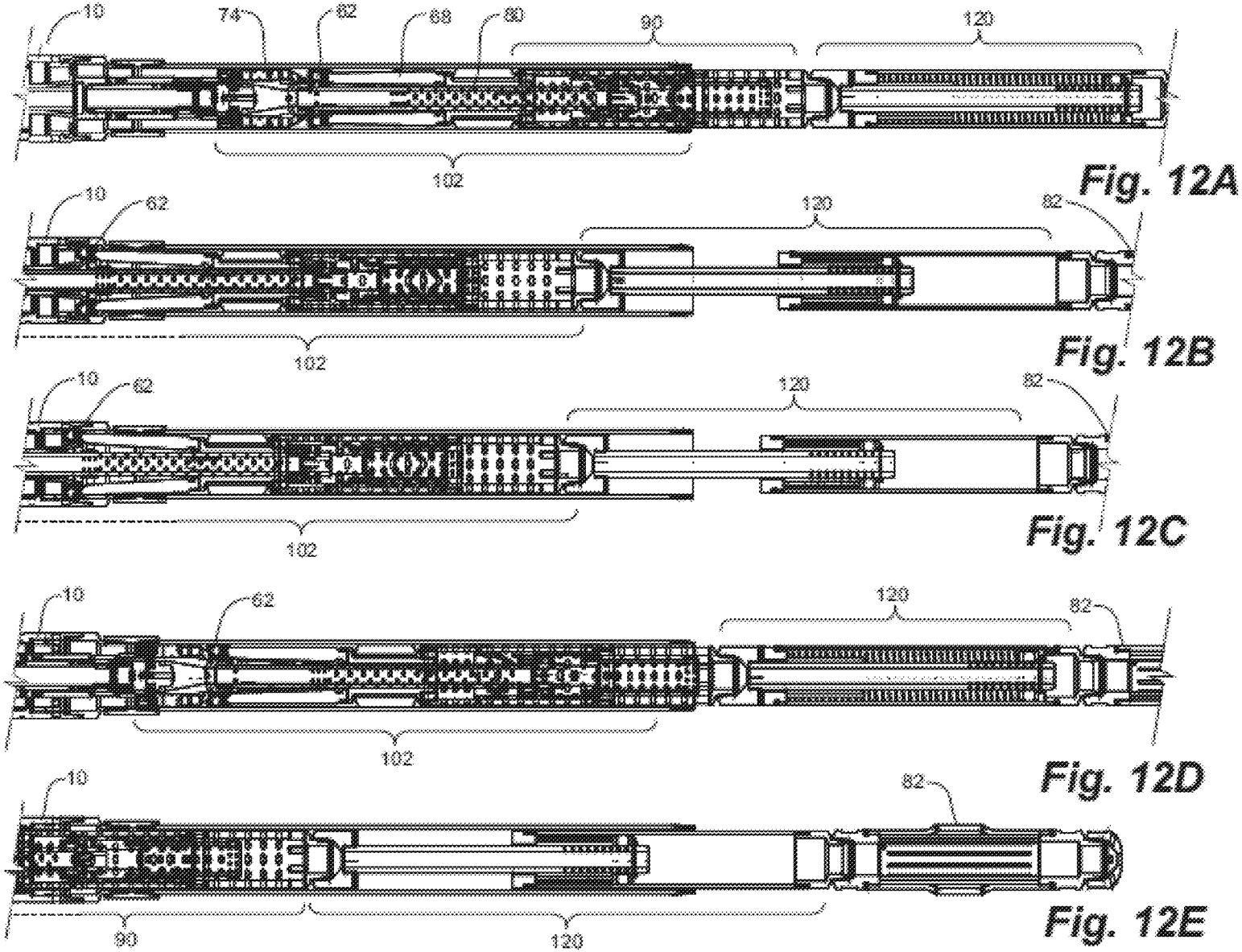
FIGS. 12A through 12E respectively are cross-sectional side views of the BHA with shifting tool and slack sub in various stages of operation, the view diameter being exaggerated for better illustrating the cross-sectional elements.
Figures 14A, 14B, 14C:
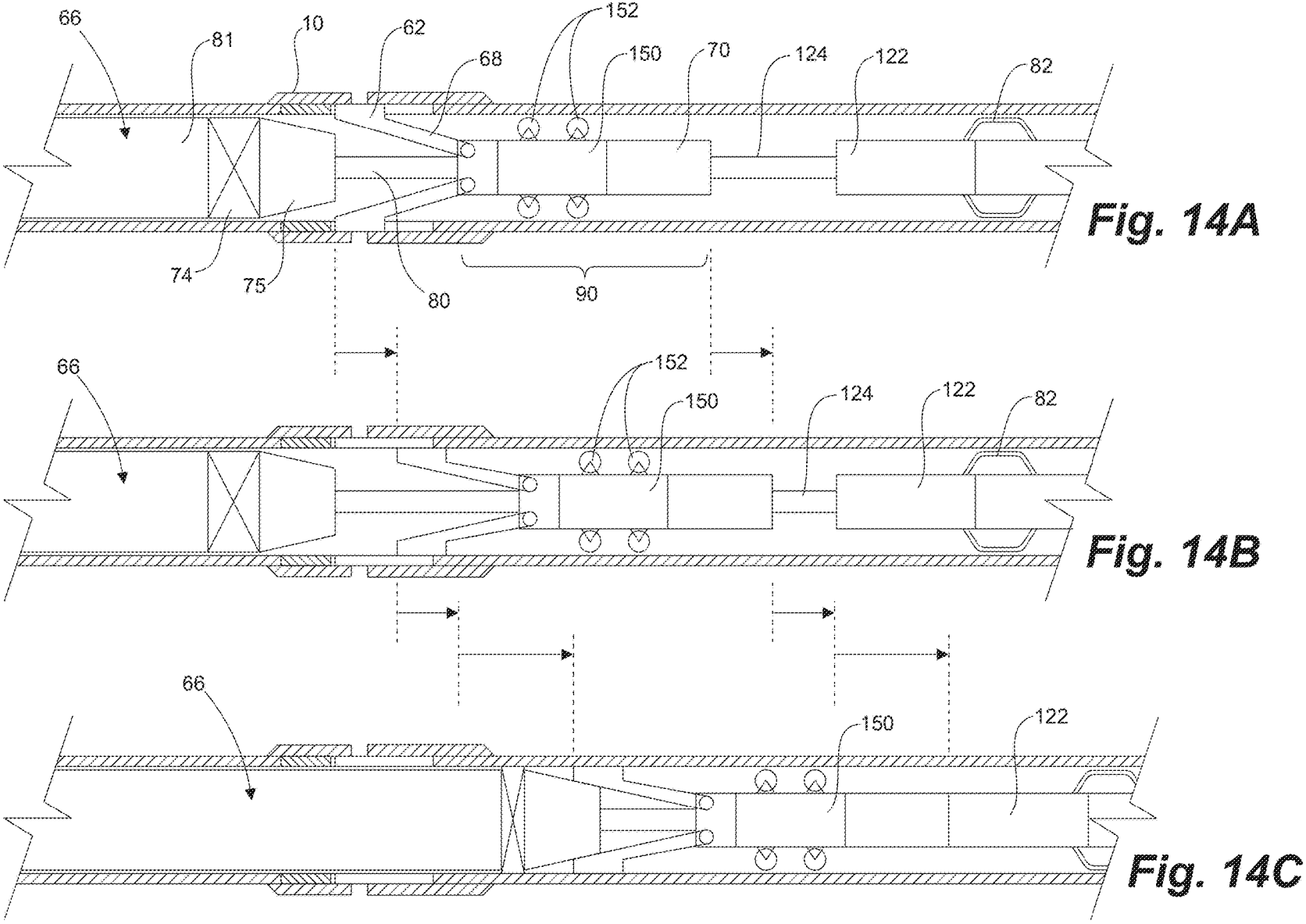
FIGS. 14A, 14B and 14C are diagrammatic illustrations of embodiments the BHA of FIGS. 11A to 11G further incorporating a roller sub to aid in downhole axial movement of the shifting tool portion of the BHA when the slack sub collapses from the extended position (FIG. 14A) to the collapsed position (FIG. 14B) and after the conveyance string follows the dogs downhole to engage and set the dogs as slips in the casing string (FIG. 14C)

As shown in FIGS. 12C and 14A, when the dogs 62 are released from the sleeve assembly 10, the energy of the drag spring 128 pulls downhole on the BHA housing 90. In FIG. 14B, the BHA housing 90, at least the arms 68 and dogs 62 are dragged downhole, spacing the dogs 62 from the cone 75 carried by the BHA mandrel 80.

The setting down of the BHA releases the energy of the extended slack sub 120, biasing the J-mechanism housing 90 and dogs 62 downhole towards the drag block 82 while the J-mechanism mandrel follows downhole, the BHA repositioning below the open, selected sleeve 10. The slack mandrel 124 telescopically extends from the slack housing 122 by a stroke length, the stroke length being greater than the distance between the spacing between the dogs and the packer 74 in the cone-engaged position and wherein upon the dogs 10 disengaging from the sleeve assembly 10, the slack mandrel 124 telescopically drags the BHA housing 90 downhole and the packer 74 is dragged downhole of the sleeve assembly 10.

As shown in FIGS. 12D and 14C, the axial magnitude of the collapsing slack sub 120 is such that, when the BHA housing 90 is biased downhole by the drag spring 128, the dogs 62 are positioned below the sleeve assembly 10 when the BHA mandrel, packer 74 and cone 75 engage the dogs 62 in SET mode and anchor the dogs in the casing 40 therebelow.

In embodiments, there is sufficient spacing between the slack housing and the slack mandrel so as to minimize adverse effects of sand and debris therein on the axial movement of the BHA housing 90 relative to the casing 40. Further, the tubular components can be perforated therethrough to assist with sand and debris removal there between.

In embodiments the slack mandrel's extended position is defined by the length of the mandrel 124 and the positioning of the adjustable spring retention nut 142 thereto.

In embodiments, the slack sub is incorporated into the drag beam assembly and is not a separate component, which acts to shorten the length of the BHA.

Method of Shifting a Uphole-Opening Sleeve

Having reference again to FIGS. 11A to 11G, 12A to 12E and 13, sleeve 12 is shifted uphole to the open position, using Applicant's BHA 102. As shown in FIG. 11A, in RIH mode, the BHA's packer 74 is relaxed and the slack sub-120 is initially in the collapsed position all of which is RIH to a depth below the sleeve assembly 10. As shown in FIG. 11C, the J-mechanism 70 is cycled to the LOC Mode as described above and the BHA 102 is pulled uphole until the radially extending dogs 62 on the arms note the sleeve housing bore 14 and engage the distal end of the sleeve 12. As shown in FIG. 11D, the BHA 102 is pulled uphole to locate the distal end 26 of the sleeve 12. During uphole movements, the frictional force of the drag beam 82 on the casing 14 exceeds that of the force to compress drag spring 128, and slack mandrel 124 telescopes axially from the slack housing 122 to the extended position.

Figure 11E:
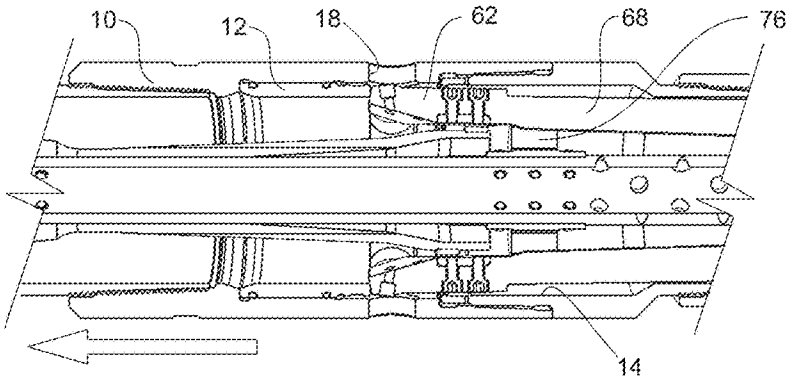

As shown in FIG. 11E, continuing to pull the BHA 102 uphole with the dogs 62 engaged with the distal end of the single-shift sleeve overcomes the first retainer 28, and the sleeve 12 is shifted uphole to open the ports 18. The packer 74 is currently located uphole of the frac ports 18 and the dogs 62 are positioned at about the frac ports. The slack sub-120 remains engaged in the extended position (FIG. 11D).

Figure 11F:
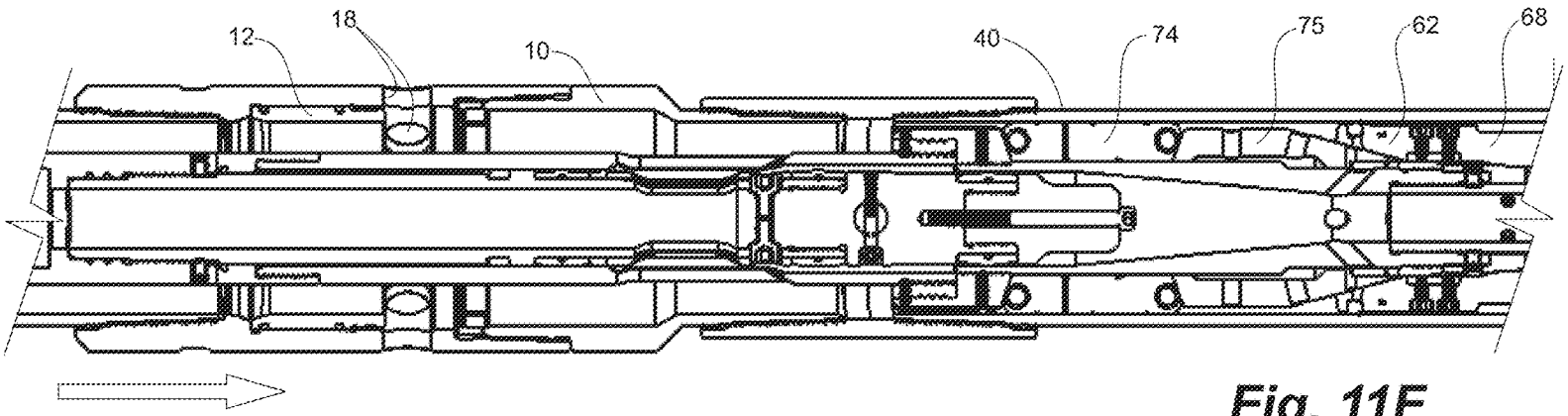

Thereafter, as shown in FIG. 11F, the J-mechanism 70 is cycled towards a SET/FRAC mode, which releases the dogs 62 and allows the drag spring 128 to drag the slack mandrel 124 downhole towards collapsed position (FIG. 11B). The BHA housing 90 attached to the slack mandrel 124 is also dragged downhole to below the sleeve assembly 10 and BHA mandrel, packer 74 and cone 75 thereon can follow without actuation.

Figure 17A:
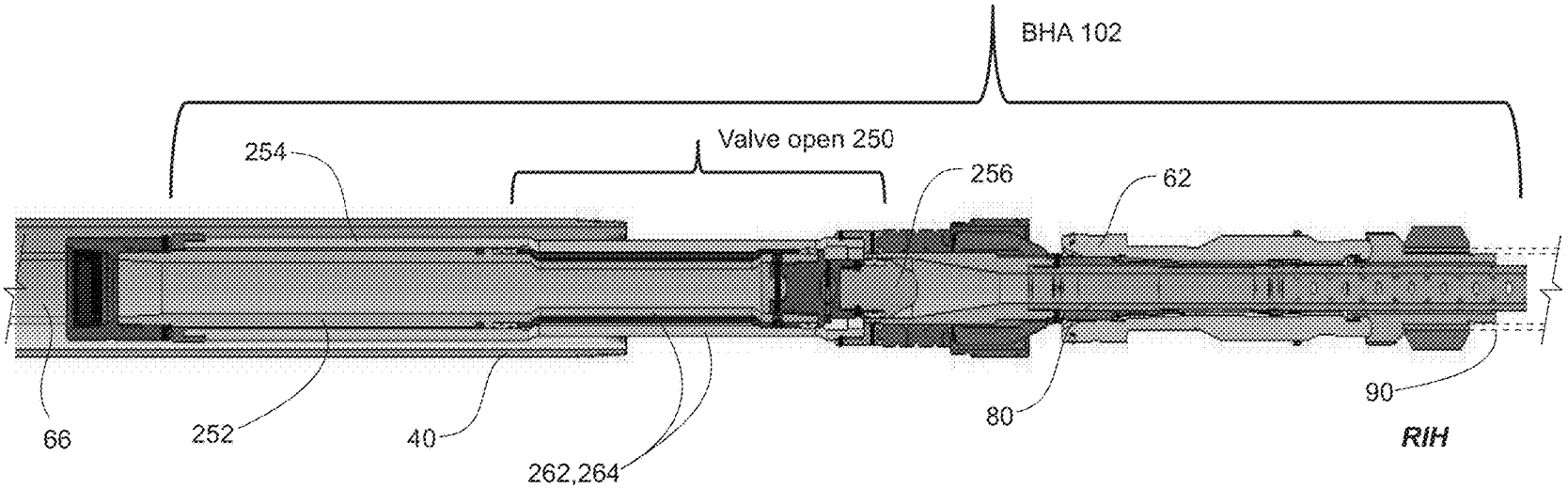
FIGS. 17A and 17B are cross-sectional, diameters exaggerated views of a slidable aperture fracturing valve above the BHA mandrel's resettable packer assembly, the BHA mandrel and lower valve sleeve portion ultimately also being axially movable relative to the conveyance string and upper valve stem portion, uphole thereof, draggable with the BHA housing once the BHA mandrel uphole J-Pins engaged one of the U1 or U2 positions of the uphole J-Profile as the BHA housing moves downhole thereabout.
Figure 17B:
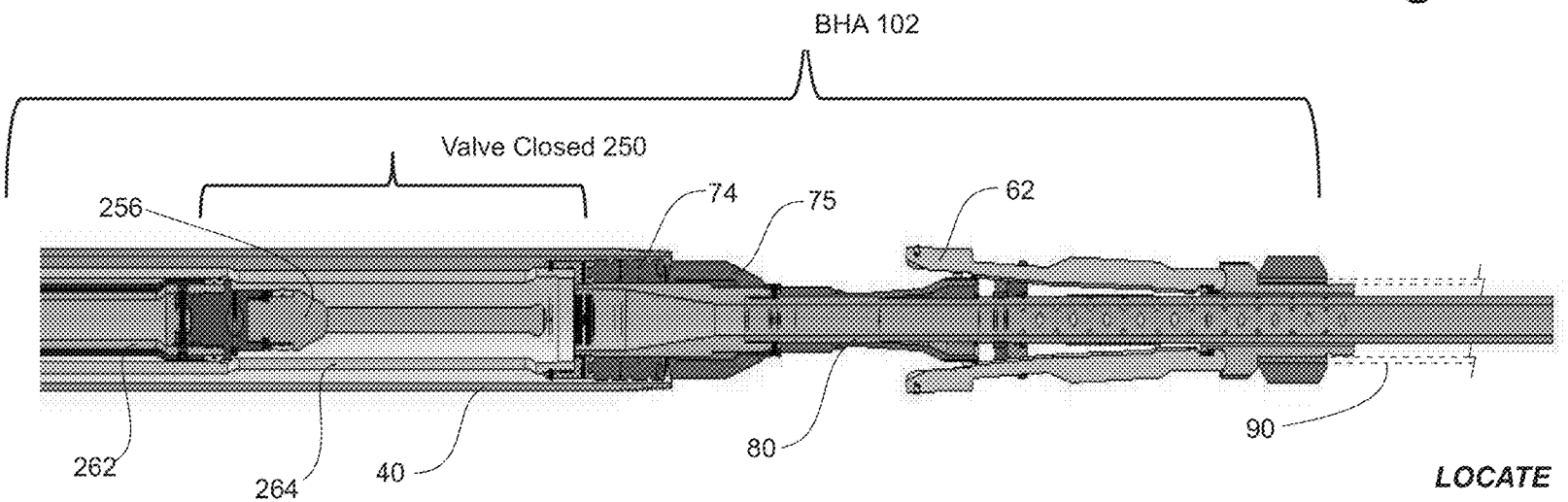

The effect of slack sub is not necessarily limited by the BHA housing 90. In FIGS. 17A and 17B, the BHA can be fit with a fracturing fluid valve 250 uphole of the packer 74. The valve 250 is telescopic, having an inner tubular valve stem 252 and an outer tubular valve sleeve 254. The inner valve stem 252 is connected to the conveyance string 66 at an uphole end and has a downhole plug 256. The outer valve sleeve 254 is connected at a downhole end to the BHA mandrel 80. When the valve stem 252 is actuated downhole, the plug 256 blocks the bore of the BHA mandrel 80 and side fluid apertures 262,264 in both the valve stem 252 and sleeve 254 respectively align for fracturing fluid egress. When the valve stem 252 is actuated uphole, upon an upward pull of the conveyance string 66, plug 256 pulls opens from the BHA mandrel 80 and the side fluid apertures 262,264 misalign for blocking fracturing fluid flow from the conveyance string 66 and valve stem aperture 262. The action of the slack sub 120 can, depending on the relative uphole downhole relationship of the conveyance string 66 and BHA 102, also drag the valve sleeve 254 portion downhole. Firstly, as BHA housing 90 is pulled downhole, the uphole J-Profile is lowered over the uphole J-Pin of the BHA mandrel 80. Once the J-Pin is engaged, by one of the U1 or U2 J-Profile positions, the BHA mandrel 80, packer 74 and cone 75 can also be dragged downhole therewith, maintaining a spaced, but close relationship with the BHA housing 80.

Once the slack sub 120 is fully in the collapsed position and there is no further downward movement of the BHA housing 90, the packer, cone and dogs are set in the casing below the sleeve assembly 10 for fracturing through the open ports 18.

Figure 11G:
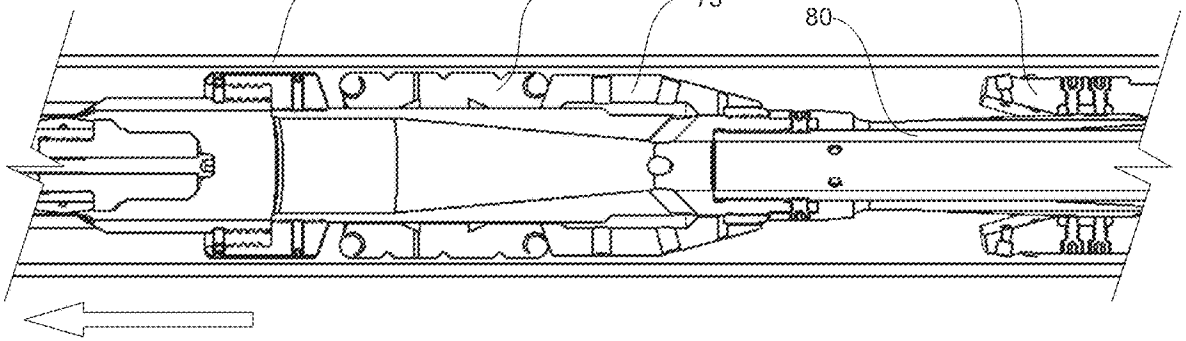

As shown in FIG. 11G, following fracturing, the J-mechanism 70 is cycled to the POOH mode, the packer 74 is again relaxed and the arms and dogs are constrained radially inwardly. The BHA 102 is then pulled uphole toward the next sleeve assembly 10 to be opened, the slack mandrel 124 once again moving axially, within the slack housing 122, to the extended position.

As with the prior BHA 100 of FIG. 6A, prior to reaching the next sleeve assembly 10, axial uphole movement is stopped, and the J-mechanism 70 is cycled to the LOC Mode so that, when pulled further uphole, the next sleeve assembly 10 to be opened can be positively located by the dogs 62 and the process as described above repeated for shifting the sleeve and fracturing through the open ports.

Low Friction Roller Sub

As shown in FIG. 6B, centralizers 91 can be provided to reduce friction between the BHA 102 and the casing 40, the centralizer generally being manufactured from low friction materials, such as polyurethane. The centralizer can enable the slack sub 120 to more effectively drag the BHA downhole as described above.

In other embodiment, and having reference to FIGS. 14A, 14B and 14C, in situations where there are significant amounts of sand or debris in the wellbore, or where there are other concerns with respect to resistance to the ability of the slack sub to reciprocate between the retracted and extended positions and reliably drag the BHA housing 90 to the collapsed position, the BHA may further comprise a roller sub 150. Centralizers and rollers are also known in the centralizing of reciprocating rod strings.

In embodiments, the roller sub 150 comprises a tubular housing having a plurality of low-friction surfaces 152 extending radially outwardly therefrom, such as pads, roller wheels or the like, to engage the casing and to reduce the effect of friction on downhole axial movement of the BHA therein when dragged by the slack sub.

As shown, in embodiments the roller sub is incorporated into the BHA housing 90 such as between the arms 68 and the J-mechanism 70.

Movement-Starting Nudge Sub

In embodiments, where there may be significant initial impediments to spring-induced dragging movement of the BHA housing, or where there are other concerns regarding the ability of the slack sub to reliably drag the BHA downhole, the BHA may further comprise a positive energy source to aid the BHA. A nudge sub 160 may be used in instead of the roller sub 150, or alternatively can be used in combination therewith, to induce initial movement of the slack sub's housing 122 and BHA housing 90.

In embodiments, the nudge sub 160 acts to provide a momentary downhole force on the slack sub's housing 122 to initiate downhole movement so as to aid the slack sub to drag the BHA housing 90 downhole.

Figure 15:
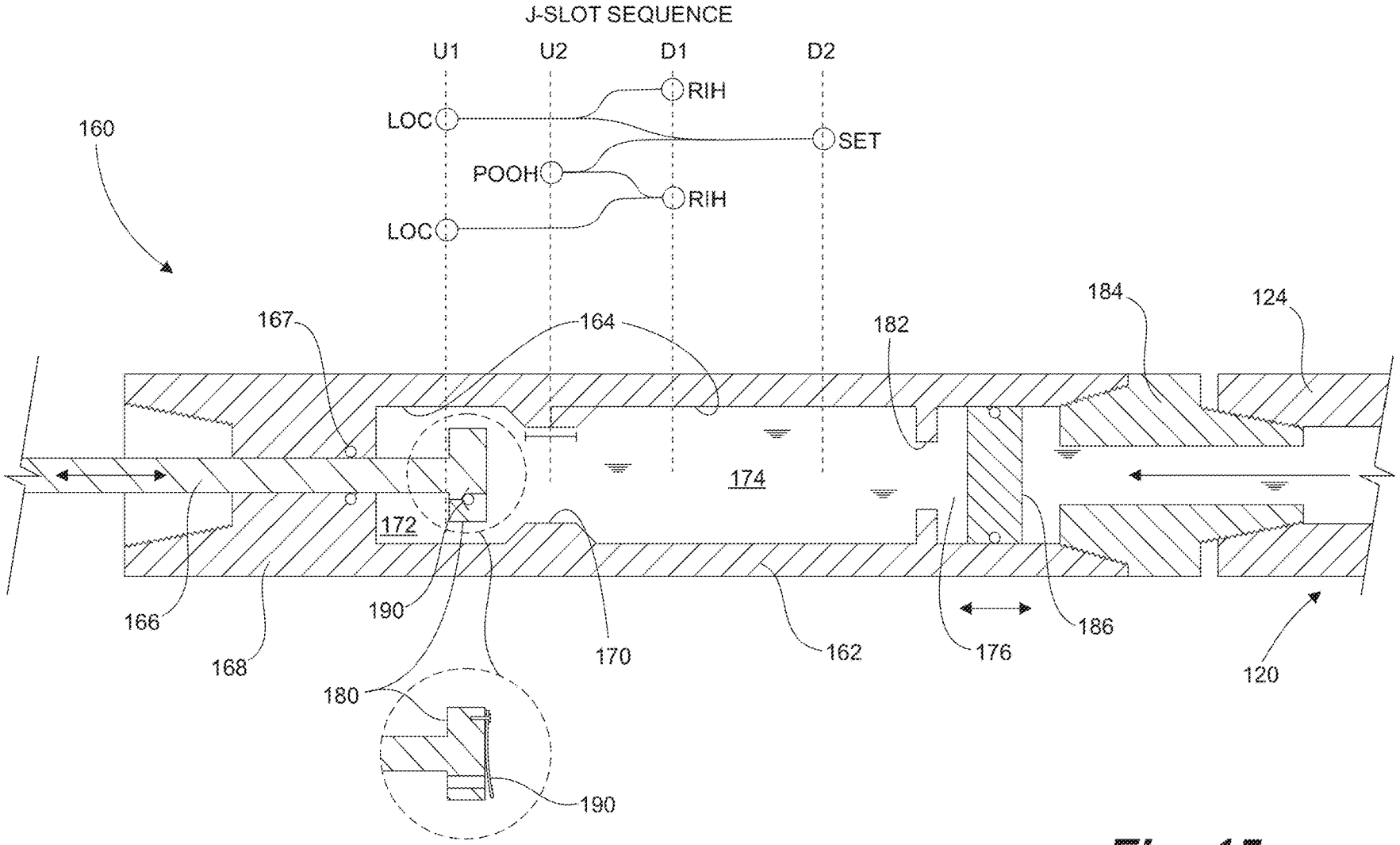
FIG. 15 is a cross-sectional schematic view of a hydraulic nudge sub for incorporation into the BHA according to embodiments taught herein, the nudge sub assisting with initiation of axial movement of the slack sub from the extended position to the collapsed position and shown in relation to a J-profile according to FIG. 13, to illustrate timing of the nudge sub.
Figure 16:
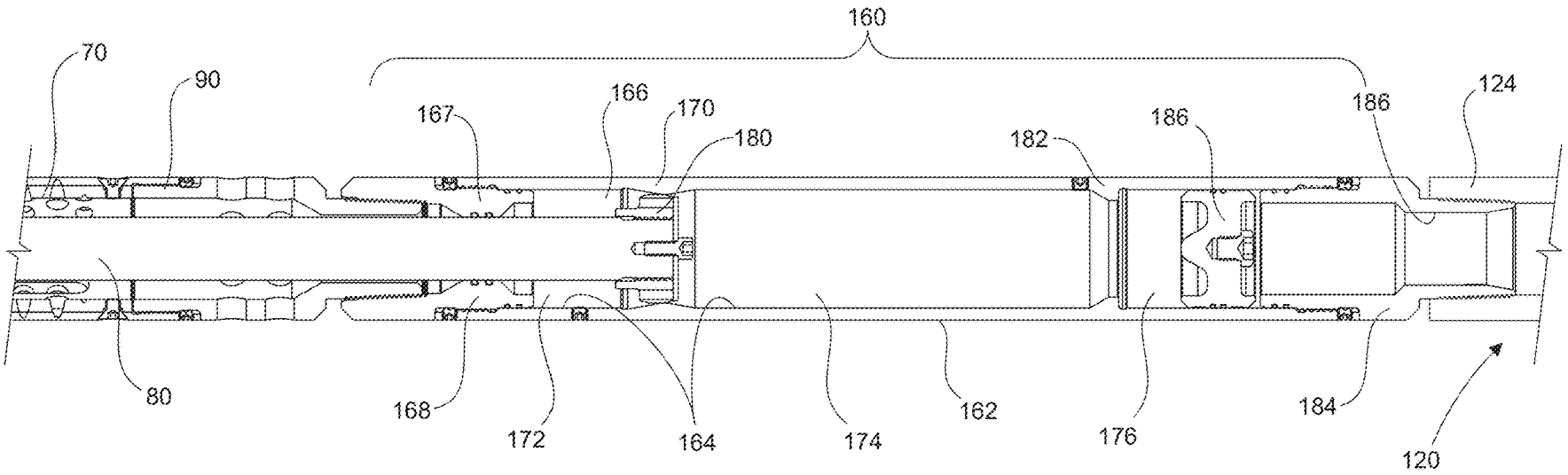
FIG. 16 is a cross-sectional view of the nudge sub of FIG. 15, the nudge mandrel shown connected to the distal or bottom end of the J-mandrel and having a nudge housing cemented between the downhole end of the J-housing and the slack mandrel and shown at a stage when the nudge mandrel is passing through a constriction for hydraulically nudging the mandrel of the slack sub connected therebelow.

Having reference to FIGS. 15 and 16, the nudge sub 160 comprises a tubular nudge housing 162 having a bore 164 therethrough. The nudge housing 162 is connected to the slack mandrel 124 of the slack sub 120 therebelow. A nudge mandrel 166 extends sealably, through seals 167, through an uphole end 168 of the housing 162 and is axially moveable along the bore 164. The nudge mandrel 166 is connected to the BHA mandrel 80 thereabove which, when cycled downhole to RIH mode, also drives the nudge mandrel 166 downhole into the nudge bore 164. A downhole end 184 of the nudge sub housing 162 is connected to the slack mandrel 124 of the slack sub 120. The nudge mandrel 162 momentarily drives the nudge housing 164 downhole so as to drive the slack mandrel 124 to move axially downhole against debris-related annular resistance.

Adjacent an uphole end of the bore 164 is a circular constriction 170, dividing the bore into an uphole chamber 172 and a main chamber 174 downhole thereof. The upper chamber 172 receives a distal end of the nudge mandrel 166 therein. The uphole and main chambers 172,174 are fluidly connected. The nudge bore 164 is filled with an incompressible fluid, such as oil.

The distal end of the nudge mandrel 166 fit with a cylindrical nudge piston 180 thereon. The diameter of the nudge piston 180 is sized to pass axially through the circular constriction. The first constriction 170 is spaced downhole from the nudge housing's uphole end 168 and forms the upper chamber 172 therebetween. The constriction 170 has a diameter slightly larger than that of the piston 180 as shown in FIG. 16, such that when the nudge piston 180 passes through the constriction 170, there is a hydraulic resistance to the passage of the piston therethrough. The axial extent or length of the constriction 172 is relatively short compared to the travel of the nudge mandrel 166 so as to provide a fluid connection for a limited duration with the slack mandrel 124 so as to initiate movement thereof as described below. Once the nudge piston 180 passes through the constriction 170, the downhole movement of the BHA mandrel 80 and connected nudge mandrel 166 is effectively disconnected from the slack sub 120.

During the passage of the piston through the constrictor 170, oil is fluidly displaced from the main chamber 174 to flow into a lower chamber 176. The oil in main chamber 174 is moved between the main and lower chamber 174,176 as the nudge mandrel 166 moves axially uphole and downhole. The lower chamber is merely a housing for the axial movement and retention of a compensator piston 186 moveable with the volume of displaced fluid.

The compensator piston 186 is located axially within the lower chamber 176 between an uphole stop 182 and the downhole sub 184, moving in response to displacement of oil as the nudge mandrel 166 moves axially within the bore 164. The compensator piston 186 is in fluid communication on the uphole side with the clean oil in the housing and is in fluid communication with the dirty wellbore fluid on the downhole side. The compensator piston 186 ensures that the pressure of the oil in the nudge sub 160 is balanced with the wellbore pressure, which varies with wellbore depth, while accommodating the movement of oil in the bore 164. Balancing the pressure in the bore 164 with the wellbore fluids of the casing string 40 ensure the mandrel seals 167 are not subjected to a high, different pressure.

Further, as shown in FIG. 15, the nudge piston 180 has a check valve 190 therein, such as flapper valve, to enable substantially free uphole movement of the nudge mandrel 166 and nudge piston 180 thereon and displacement of fluid from the uphole chamber 172, such as when the BHA is pulled uphole (POOH) and the nudge piston 180 resets by passing uphole through the constrictor 170.

As can be seen in FIG. 15, wherein the nudge sub 160 is shown juxtaposed with J-profile of FIG. 13, the location of the constriction 170 is coordinated axially, within the nudge housing 162, with respect to the cycling of the J-mechanism. The constriction 170 is spaced along the nudge sub 160 so to coordinate the timing of the push or nudge, applied by the nudge housing 162 to the slack mandrel 124, with release of the dogs 62 and the dragging action of the slack mandrel 124 intermediate the BHA cycle to the SET mode at D2 of the J-Profile. In embodiments, the nudge piston 180 reaches the constriction 170 as the arms and dogs 62 of the BHA are being constrained radially inwardly at U2 of the J-Profile so as to allow free axial movement of the BHA downhole within the wellbore.

In use, when the J-mechanism 70 is cycled to SET mode, the BHA mandrel 80, the nudge mandrel 166, and the nudge piston 180 are permitted to move freely downhole until the piston reaches the constriction 170. A momentary hydraulic restriction is formed thereat, which effectively acts to momentarily lock or couple the nudge piston 180 to the nudge housing 162. The coupled movement of the nudge housing 162 causes a forceful downhole movement of the slack sub's mandrel 124 towards the collapsed position, breaking a stuck BHA housing 90 free of the casing string and permitting the energy of the compressed spring 128 to take over to drag the BHA housing 90 downhole therewith.

In embodiments, the nudge sub 160 may assist in initiating movement from a static friction mode to a dynamic friction mode such that the slack mandrel 124 and spring 168 can maintain dragging movement under the lower dynamic friction conditions.

The invention claimed is:

1. A bottom hole assembly (BHA) conveyed downhole on a conveyance string for actuating a selected sleeve assembly of one or more sleeve assemblies located along a completion string, comprising:

a shifting tool comprising a BHA mandrel slidable within a BHA housing downhole thereof, the BHA mandrel having a resettable packer thereon, the BHA housing having slips and one or more sleeve engagement elements at an uphole end thereof, wherein the packer is released when spaced from the slips and set when engaged therewith;

a drag block downhole of the shifting tool for impeding movement of the BHA housing relative to the completion string;

a telescopic BHA repositioning sub connected to the shifting tool, the repositioning sub having a slack mandrel telescopically-coupled to a slack housing, wherein the telescopic BHA repositioning sub is telescopically extendible and collapsible between:

an axially extended configuration in which the one or more sleeve engagement elements engage the selected sleeve assembly with the packer spaced from the slips; and an axially collapsed configuration in which the one or more sleeve engagement elements are shifted downhole of the selected sleeve assembly, towards the drag block, with the packer spaced from the slips;

wherein, when the telescopic BHA repositioning sub is in the axially collapsed configuration, the BHA mandrel is movable with respect to the BHA housing to engage the packer with the slips to set the packer.

2. The BHA of claim 1, wherein the one or more sleeve engagement elements are movable axially relative to the BHA mandrel and radially actuable between a radially outward biased position to engage and shift the selected sleeve assembly to an open treatment position, and a radially inward collapsed position for free movement in the completion string.

3. The BHA of claim 1, wherein:

the slack mandrel telescopically extends from the slack housing by a stroke length, the stroke length being greater than a distance between the spacing between the slips and the packer when the sleeve engagement elements are engaged with the selected sleeve assembly.

4. The BHA of claim 2, further comprising a cone movable axially with the BHA mandrel between two positions: an engaged position with the sleeve engagement elements to urge the sleeve engagement elements to the radially outward position; and a disengaged position.

5. The BHA of claim 4, wherein the packer is set to seal the completion string when the cone is in the engaged position.

6. The BHA of claim 1, further comprising a spring between the slack mandrel and the slack housing, wherein the spring is energized when the slack mandrel is telescopically extended and spring energy is released when the slack mandrel is collapsed.

7. The BHA of claim 6, wherein the release of the spring energy moves the telescopic BHA repositioning sub from the axially extended position to the axially collapsed position.

8. The BHA of claim 1, wherein the one or more sleeve engagement elements act as the slips.

9. The BHA of claim 1, wherein the shifting tool further comprises a J-mechanism between the BHA mandrel and the BHA housing.

10. The BHA of claim 9, wherein the J-mechanism has at least four axial positions:

an intermediate downhole position D1 in which the one or more sleeve engagement elements are constrained radially inward for free run-in hole (RIH) movement downhole;

an extreme uphole position U1 in which the one or more sleeve engagement elements are biased radially outward for locating (LOC) an annular recess in a sleeve housing of the selected sleeve assembly, the recess being adjacent and downhole of a sliding sleeve within the sleeve housing;

an extreme downhole position D2 for setting (SET) the packer and the slips across the completion string; and an intermediate uphole position U2 in which the one or more sleeve engagement elements are constrained radially inward for free pull-out-of-hole (POOH) movement uphole.

* * * * *